US012178239B2

(12) United States Patent
Ademe

(10) Patent No.: US 12,178,239 B2
(45) Date of Patent: Dec. 31, 2024

(54) APPARATUS AND METHOD FOR FILLING RODS WITH BEADED SUBSTRATE

(71) Applicant: R.J. Reynolds Tobacco Company, Winston-Salem, NC (US)

(72) Inventor: Balager Ademe, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 287 days.

(21) Appl. No.: 17/749,715

(22) Filed: May 20, 2022

(65) Prior Publication Data

US 2022/0279839 A1 Sep. 8, 2022

Related U.S. Application Data

(62) Division of application No. 16/781,810, filed on Feb. 4, 2020, now Pat. No. 11,369,136.

(51) Int. Cl.

| | |
|---|---|
| ***A24C 5/18*** | (2006.01) |
| ***A24C 5/28*** | (2006.01) |
| ***A24D 3/02*** | (2006.01) |
| *A24C 5/356* | (2006.01) |

(52) U.S. Cl.

CPC ..... *A24D 3/0216* (2013.01); *A24C 5/1842* (2013.01); *A24C 5/1892* (2013.01); *A24C 5/28* (2013.01); *A24C 5/356* (2013.01)

(58) Field of Classification Search

CPC ..... A24C 5/1892

See application file for complete search history.

(56) References Cited

U.S. PATENT DOCUMENTS

| | | | |
|---|---|---|---|
| 4,474,190 | A | 10/1984 | Brand |
| 4,538,626 | A | 9/1985 | Hinzmann |
| 4,708,151 | A | 11/1987 | Shelar |
| 4,714,082 | A | 12/1987 | Banerjee et al. |
| 4,732,168 | A | 3/1988 | Resce et al. |
| 4,756,318 | A | 7/1988 | Clearman et al. |
| 4,844,100 | A | 7/1989 | Holznagel |
| 4,911,184 | A | 3/1990 | Case et al. |
| 5,105,831 | A | 4/1992 | Banerjee et al. |

(Continued)

OTHER PUBLICATIONS

R.J. Reynolds Tobacco Company, "Chemical and Biological Studies on New Cigarette Prototypes That Heat Instead of Burn Tobacco", monograph excerpts, 1988, 9 pages.

*Primary Examiner* — Eric Yaary

(74) *Attorney, Agent, or Firm* — Womble Bond Dickinson (US) LLP

(57) ABSTRACT

A system for portioning a beaded substrate in a rod. The system includes a suction conveyor belt. The suction conveyor belt includes a belt suction chamber, a first belt end, and a second belt end, the second belt end opposite and downstream of the first belt end. The system also includes a metering device configured to provide the beaded substrate to the suction conveyor belt, and more specifically to the first belt end. The metering device includes a reach and a hopper. The metering device may provide the beaded substrate to the first belt end prior to the suction conveyor belt biasing a filler material onto the first belt end. The system may further includes a cutting mechanism that cooperates with the metering device to position the beaded substrate a first distance away from a first cut end.

21 Claims, 19 Drawing Sheets

(56) References Cited

U.S. PATENT DOCUMENTS

| | | | | |
|---|---|---|---|---|
| 5,360,023 | A | 11/1994 | Blakley et al. | |
| 5,469,871 | A | 11/1995 | Barnes et al. | |
| 6,516,809 | B1 | 2/2003 | Schumacher | |
| 7,363,929 | B2 | 4/2008 | Fagg et al. | |
| 7,479,098 | B2 | 1/2009 | Thomas et al. | |
| 7,503,330 | B2 | 3/2009 | Borschke et al. | |
| 7,537,013 | B2 | 5/2009 | Nelson et al. | |
| 7,654,945 | B2 | 2/2010 | Deal | |
| 7,753,056 | B2 | 7/2010 | Borschke et al. | |
| 8,381,947 | B2 | 2/2013 | Garthaffner et al. | |
| 8,512,213 | B2 | 8/2013 | Deal | |
| 8,574,141 | B2 | 11/2013 | Barnes et al. | |
| 8,869,969 | B2 | 10/2014 | Cieslikowski et al. | |
| 8,960,199 | B2 | 2/2015 | Zhuang et al. | |
| 9,004,261 | B2 | 4/2015 | Cieslikowski et al. | |
| 9,067,697 | B2 | 6/2015 | Gruss et al. | |
| 9,149,072 | B2 | 10/2015 | Conner et al. | |
| 9,247,770 | B2 | 2/2016 | Barnes et al. | |
| 2003/0106561 | A1* | 6/2003 | Schumacher | A24C 5/1892 131/31 |
| 2004/0129281 | A1* | 7/2004 | Hancock | A24C 5/00 131/284 |
| 2005/0070409 | A1 | 3/2005 | Deal | |
| 2010/0101589 | A1 | 4/2010 | Nelson et al. | |
| 2011/0155154 | A1 | 6/2011 | Zhuang et al. | |
| 2011/0259351 | A1* | 10/2011 | Beroth | A24C 5/18 131/58 |
| 2012/0060446 | A1 | 3/2012 | Merz | |
| 2013/0167851 | A1 | 7/2013 | Ademe et al. | |
| 2015/0157052 | A1 | 6/2015 | Ademe et al. | |

* cited by examiner

APPARATUS AND METHOD FOR FILLING RODS WITH BEADED SUBSTRATE

CROSS-REFERENCE TO RELATED APPLICATIONS

This application is a divisional of U.S. application Ser. No. 16/781,810, filed on Feb. 4, 2020, which application is hereby incorporated by reference in its entirety in this application.

TECHNICAL FIELD

The present disclosure relates generally to systems and methods for manufacturing smoking articles.

BACKGROUND

Popular smoking articles, such as cigarettes, have a substantially cylindrical rod shaped structure and include as charge, roll, or column of smokable material, such as shredded tobacco (e.g., in cut filler form), surrounded by a paper wrapper, thereby forming a so called "smokable rod", "tobacco rod" or "cigarette rod." Normally, a cigarette has a cylindrical filter element aligned in an end to end relationship with the tobacco rod. Preferably, a filter element comprises plasticized cellulose acetate tow circumscribed by a paper material known as "plug wrap." Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999), U.S. Pat. No. 7,503,330 to Borschke et al., U.S. Pat. No. 5,360,023 to Blakley et al., U.S. Pat. No. 4,911,184 to Case et al., U.S. Pub. No. 2013/0167851 by Ademe et al., U.S. Pat. No. 9,247,770 to Barnes et al., and U.S. Pat. No. 8,574,141 to Barnes et al., which are incorporated herein by reference.

Through the years, efforts have been made to improve upon the components, construction, and performance of smoking articles. See, for example, the background art discussed in U.S. Pat. No. 7,753,056 to Borschke et al. Among the techniques used to assemble segmented smoking articles, including the attachment of filter segments to other rod components is the use of circumscribing wrapping material, such as paper wrapping. One such example of this is so called tipping paper.

There often may be a desire to add a bead or a beaded substrate to the rod to provide a flavor to the smoking experience of the user. Such a bead or beaded substrate may be incorporated, for example, into a heat-not-burn tobacco product, where the substrate, such as by way of example, a tobacco substrate, is heated sufficient to induce vapors, but the substrate itself is not burned or ignited. Examples of such heat-not-burn products are discussed, for example, in U.S. Pat. No. 4,708,151 by Shelar, U.S. Pat. No. 4,714,082 by Banerjee et al., U.S. Pat. No. 4,732,168 by Resce et al., U.S. Pat. No. 4,756,318 by Clearman et al., and U.S. Pat. No. 5,469,871 by Barnes et al., each of which are incorporated by reference in their entirety.

Tobacco rods are commonly manufactured by first making a long, continuous tobacco rod and then cutting the continuous rod to the desired length. If beaded substrate were simply mixed in among the tobacco product within the tobacco rods, it would not be possible to control where in the tobacco rod the beaded substrate ends up. In that case, the continuous tobacco rod may be cut too close to where a bead is, causing the bead to fall out of the tobacco rod. It is also possible to accidently cut the bead when cutting the continuous tobacco rod.

Accordingly, it would be desirable to provide an apparatus that can insert beads or a beaded substrate into a rod during the manufacturing of the rod at specific time intervals, and more specifically cooperate with a cutting mechanism to cut the rod separate from the beads or beaded substrate.

BRIEF SUMMARY

According to a first set of embodiments, a system for portioning a beaded substrate in a rod is provided. The system includes a suction conveyor belt. The suction conveyor belt includes a belt suction chamber, a first belt end, and a second belt end. The second belt end is opposite of and downstream of the first belt end. The system further includes a metering device configured to provide the beaded substrate to the first belt end. The metering device includes a reach and a hopper.

According to a second set of embodiments, a method for filling a rod with filler material and beaded substrate is provided. The method includes depositing filler material into a filler conduit and depositing the beaded substrate into the filler conduit using a metering device. The beaded substrate mixes with the filler material to form aerosol generating product components. The method further includes depositing the aerosol generating product components on a spreader belt, transferring the aerosol generating product components from the spreader belt to a chimney portion, and forming a stream of aerosol generating product components by suctioning the aerosol generating product components from the chimney portion onto a belt of a suction conveyor system.

According to a third set of embodiments, a method for filling a rod is provided. The method includes presenting, by a metering device at predetermined time intervals, a beaded substrate proximate a suction belt assembly. The beaded substrate is then released from the metering device and biased away from the metering device by the suction belt assembly and onto a belt of the suction belt assembly. The method further includes advancing the beaded substrate and the belt downstream through a chimney portion comprising filler material and forming a stream of aerosol generating product components. The stream of aerosol generating product components is generated by suctioning the filler material from the chimney portion onto the belt and among the beaded substrate. The stream of aerosol generating product components is advanced longitudinally toward a trimming assembly and a portion of the stream of aerosol generating product components is trimmed to a uniform thickness. The portion of the stream of aerosol generating product components is then disposed onto a paper web.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings. Example embodiments of the present application will now be described, by way of example only, with reference to the accompanying drawings, which are not necessarily drawn to scale, and wherein:

DETAILED DESCRIPTION

Figure 1:
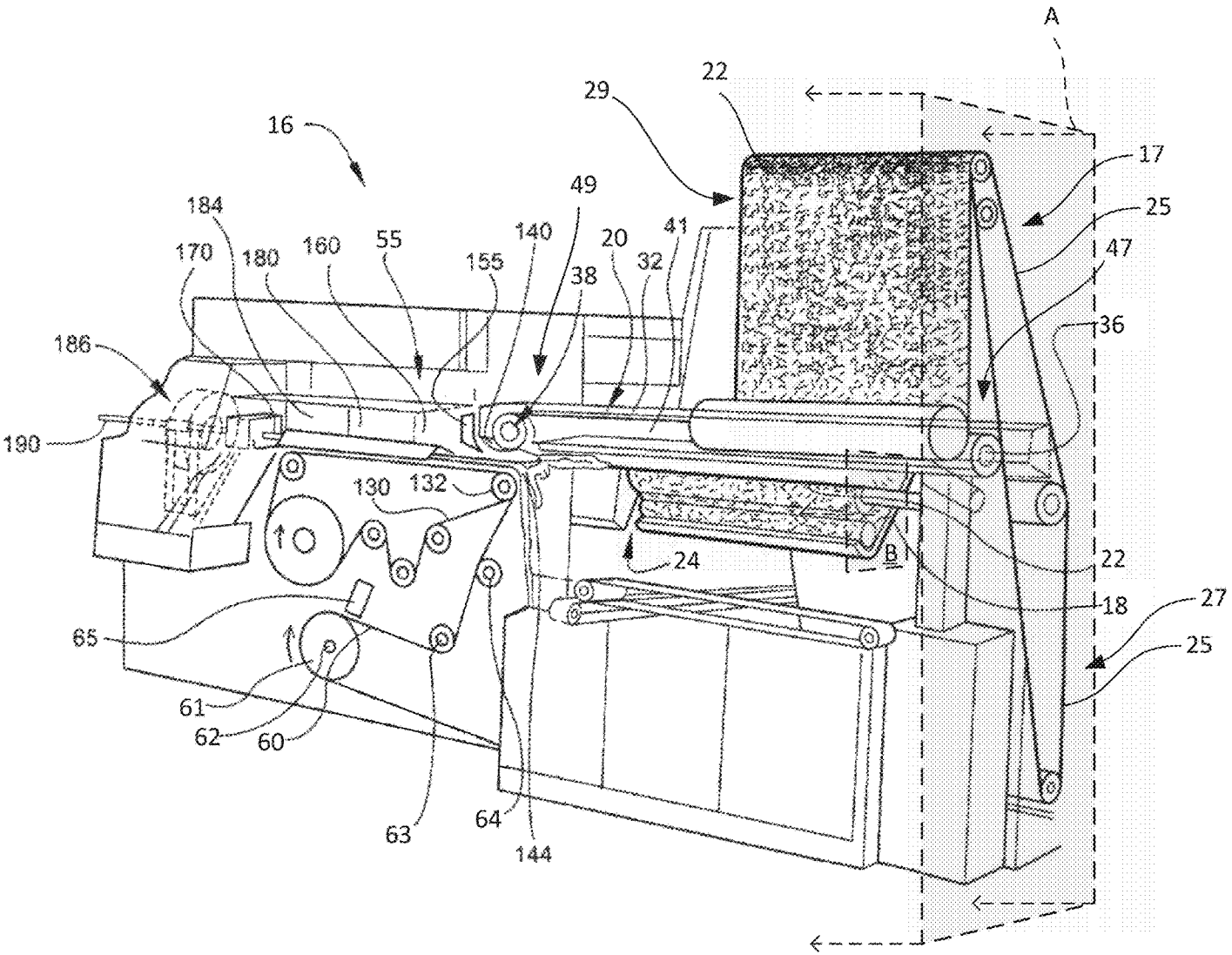
FIG. 1 is a perspective view of a system configured to form a smoking article, according to an example embodiment.

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will be thorough and complete, will fully convey the scope of the disclosure to those skilled in the art, and will satisfy applicable legal requirements. Like numbers refer to like elements throughout. As used in this specification and the claims, the singular forms "a," "an," and "the" include plural referents unless the context clearly dictates otherwise.

The present disclosure relates to a system and a method of timing, aligning, and disposing a beaded substrate (or one or more beaded substrates) into a rod at specific points during the formation (e.g., manufacturing process, etc.) of the rod. Generally, the system is configured such that the beaded substrate is provided within a stream of filler material (e.g., smokable material, tobacco material, etc.) such that the filler material and the beaded substrate are wrapped in a paper web and transformed into the rod. In some embodiments, the beaded substrate is disposed on the belt proximate a suction chamber before the filler material is biased against the belt and later deposited on the paper web. In other embodiments, the beaded substrate is deposited within the stream of filler material after the filler material is suctioned to the belt. In still other embodiments, the beaded substrate is disposed within the stream of filler material after the filler material has been deposited on the paper web, immediately prior to wrapping the filler material and the beaded substrate in the paper web to form the rod.

Once the beaded substrate is disposed within the rod, the system may use a knife segment or cutting mechanism to time a cut of the rod at specific points between a plurality of beaded substrate fill points to impede fallout (e.g., falling out) of the beaded substrate from the rod.

In some embodiments, the beaded substrate includes at least one bead. The bead(s) (e.g., micro-beads, balls, microspheres, pellets, discrete small units, extruded or compressed cylindrical or spherical elements, etc.) may be produced from a formulation that incorporates tobacco, components of tobacco and/or materials that are otherwise derived from tobacco. In some embodiments, the bead also includes other products, such as processing aids, tobacco, powdered tobacco, marumarized and/or non-marumarized tobacco, glycerin, menthol, aerosol, aerosol precursor, flavorant, or any number of other aerosol generating substrates. Marumarized tobacco is known, for example, from U.S. Pat. No. 5,105,831 to Banerjee, et al., incorporated herein by reference in its entirety. Marumarized tobacco may include about 20 to about 50 percent (by weight) tobacco blend in powder form, with glycerol (at about 20 to about 30 percent by weight), calcium carbonate (generally at about 10 to about 60 percent by weight, often at about 40 to about 60 percent by weight), along with binder and flavoring agents. The binder may include, for example, a carboxymethyl cellulose (CMC), gums (e.g., guar gum), xanthan, pullulan, or alginates.

The bead may incorporate flavors and a visible aerosol forming material (e.g., glycerin or other material that generates a visible vapor that resembles smoke). That is, components of the bead may be configured to act as substrate components for volatile flavors, vapor forming materials and aerosol forming materials that are carried thereby. In other aspects, the bead may be heat sensitive so as to rupture when heated to release glycerin and tobacco flavor and/or nicotine. Also, in some aspects, the bead may be comprised of, for example, alumina, absorbent clay, silica, and/or absorbent carbon to hold and release an aerosol former. The bead may further include a binder. In other embodiments, the bead includes an adhesive to help secure the bead within the stream of aerosol generating product components during and after manufacturing.

The beaded substrate may include alumina (e.g., Alpha-alumina, etc.) beads. The alumina beads, having a porous structure, may absorb various substrates (e.g., volatile aerosol-forming materials), such as glycerol, flavoring agents, and spray-dried tobacco. The various substrates are maintained within the alumina bead until heated. The various substrates reside within the pores of the alumina bead until sufficient heat is delivered for vaporization. Alpha-alumina is a stable phase of aluminum oxide having a rhombohedral crystalline lattice. The structure essentially consists of hexagonally packed oxygen ions forming layers parallel to the lattice plane. Generally speaking, the crystalline arrangement consists of alternating layers of oxygen and aluminum ions in which the coordination number of the aluminum ion is six. The structure is extremely stable and does not change over a temperature range from 25° C. to at least 2000° C. Its melting point is 2015° C., and its boiling point is 2980° C.

In some embodiments, an aerosol precursor composition may be applied to (e.g., absorbed within, etc.) the beaded substrate or the bead, such as the alumina bead. The aerosol precursor composition that may be applied to the bead, materials used to make the bead, and/or other components that may be incorporated into the rod, may additionally or alternatively include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD))

The beaded substrate may include beads of various sizes, small enough such that hundreds (e.g., 100, 200, 300, etc.) could fit in a single rod approximately 80 millimeters long. In other such embodiments, the beads may have a diameter equal to the diameter of the rod of a smoking article (e.g., aerosol generating product, etc.). In other embodiments, the beads may be any size in between. It may be desirable to add multiple beads in line, equidistant from one another and separated from open cut ends.

As used herein, "filler material" may include tobacco material, such as shredded tobacco, reconstituted leaf, blended leaf, improved stem, expanded stem, expanded tobacco a blend of flavorful and aromatic tobaccos in cut filler form, or similar smokable material. Filler material may also include other smokable and non-smokable material, such as pellets, discrete small units, carbon pieces, extruded carbon pieces, fillers, flavors, visible aerosol forming materials, binders, ovoid elements, irregularly shaped elements, shredded pieces, flakes, and combinations thereof.

As used herein, "aerosol generating product components" refers to any combination of the filler material and the beaded substrate. By way of example, adding the beaded substrate to a stream of filler material forms a stream of aerosol generating product components. A stream of aerosol generating product components may include a stream of filler material with the beaded substrate portioned within. A mixture of the filler material and the beaded substrate, such as in a bag, sack, tub, or similar container, may be referred to as a bag of aerosol generating product components.

As used herein, "rod" refers to a rod (e.g., paper rod, etc.) where at least a portion is filled with the filler material, the beaded substrate, or a combination thereof. A rod may be entirely filled with the filler material. In some embodiments, the rod may be entirely filled with the beaded substrate. In even other embodiments, the rod may be filled with a mixture of the filler material and the beaded substrate in any ratio of weight percent or volume percent (e.g., 0.01 wt % filler material and 99.99 wt % beaded substrate). A rod including a mixture of the filler material and the beaded substrate may be properly referred to as a rod including the aerosol generating product components.

As used herein, "smoking article" refers to a product that a user is able to smoke. A smoking article may also be referred to as an "aerosol generating product." Examples of smoking articles include cigarettes, cigs, cigars, cigarillos, pipes, hookah, bowls, bongs, and similar smoking apparatuses. Further examples of a "smoking article" may include heat-not-burn (HNB) products (e.g., carbon-tipped tobacco heating product (CTHP), electric tobacco heating product (ETHP), etc.), or cigarette-like products that heat tobacco such as to vaporize it, but do not burn the tobacco (e.g., do not heat the tobacco so high as to create smoke). The smoking article may also include a filter to help smoothen the puff inhaled by a user. Frequently, the smoking article includes a rod and a filter, sometimes combined using tipping paper. The smoking article may also include the beaded substrate disposed within, at any interval and in any amount, the rod. It may be desirable to add a single bead to the rod near the filter. In some embodiments, it may be desirable to add the bead at an end of the rod opposite the filter.

As used herein, a "metering device" refers to an apparatus for disposing and portioning the beaded substrate within a rod. In some embodiments, the metering device may portion the beaded substrate spaced at predetermined intervals along a length of the rod. The metering device may dispose the beaded substrate within a stream of filler material, forming a stream of aerosol generating product components. The metering device may be similar to the apparatus described in U.S. Pat. No. 7,479,098, incorporated herein by reference in its entirety. The metering device may include an upper hopper that acts as a reservoir for the beaded substrate, and provides the beaded substrate to a lower hopper. The bottom of the lower hopper is shaped so as to cooperate with a portion of upper region of a rotating wheel that is positioned so as to rotate in a vertical plane, and the beaded substrate is fed from the lower hopper onto the peripheral face of that rotating wheel. That is, the beaded substrate within the lower hopper is aligned in a single line along a portion of the peripheral face in the upper region of the rotating wheel.

The metering device may be similar to the apparatus described in U.S. Pat. No. 7,654,945, incorporated herein by reference in its entirety. The metering device may include a first rotatable member having a horizontal pan for supporting a plurality of individual objects and a plurality of stems located at predetermined intervals around the periphery of the pan. The stems may have an object seat at an upper end of the stem and may have vertical actuation to rise and lower the seat from a position below the pan to a position above the pan as the horizontal pan rotates about a central axis. The apparatus also includes means for positioning the individual objects within the rod 190 at predetermined intervals.

The metering device may be similar to the MCBalance metering device sold by MOVACOLOR. The MCBalance device is a gravimetric high precision dosing system that uses a feed screw to meter and dose a beaded substrate into a paper web, onto a spreader belt, or directly into filler material. The MCBalance device may accept control parameters through a user interface, control parameters including a dosing speed, dosing position, or dosing percentage. The MCBalance device may also communicate with a knife segment or cutting mechanism such that the wrapped filler material, or a continuous rod, may be cut away from where the beaded substrate is positioned.

There are many ways to manufacture a rod for use in a smoking article. One way is to add (e.g., pour, place, insert, etc.) the filler material and the beaded substrate into a pre-rolled paper rod, as disclosed in U.S. Pat. No. 7,537,013, for example. If a user so desires, the beaded substrate or the bead may be added to the rod during filling. For example, the user may fill the pre-rolled paper rod half-way with the filler material, then add a bead into the rod, and then continue filling the pre-rolled paper rod with the filler material until the pre-rolled paper rod is full, thus disposing the bead in the middle of the per-rolled paper rod. Switching back and forth between filling the per-rolled paper rod with the filler material and the beaded substrate allows the user to position the beaded substrate within the rod in a variety of positions, such as away from the cut ends of the rod. This is desirable so that the beaded substrate will not fall out of the rod during transport to a store, in the packaging box, or in a consumer's pocket, bag, purse, or hand. The machine described by U.S. Pat. No. 7,537,013 is usually reserved for manufacturing small batches of smoking articles and rods.

It is presently desirable to add a substrate, such as the beaded substrate or the bead, to the filter rod of a smoking article to smoothen and/or flavor a puff from the smoking article. However, adding the bead or the beaded substrate to the rod in large quantities has proven challenging because it is more difficult to manufacture, as rods have a narrow diameter, often ranging between 7-10 mm. Quickly manufacturing rods at high volumes that have both the filler material and the beaded substrate disposed within has proven challenging.

A rod wrapping machine (e.g., rod wrapping system, rod formation system, system, etc.) described herein addresses the issues of high-volume and/or increased manufacturing speed found in current rod wrapping machines. In general, the rod wrapping machine disposes aerosol generating product components onto a paper web coming off a bobbin. The rod wrapping machine wraps the aerosol generating product components in the paper web to form a continuous rod, and then cuts the continuous rod to the desirable length, making a rod. The rod wrapping machine may be configured to pass the formed and cut rod to a filter assembler. The filter assembler may couple the rod to the filter using a wide variety of formation methods, and most commonly using tipping paper. In some embodiments, the rod wrapping machine may dispose only the filler material on a paper web, wrap the filler material in the paper web, and form a rod including only the filler material. In other embodiments, the rod wrapping machine may dispose only the beaded substrate on a paper web, wrap the filler material in the paper web, and form a rod including only the beaded substrate.

Expanding generally, the rod wrapping machine addresses the issue of spillage of the beaded substrate during the cutting of the rod. In some embodiments, the rod wrapping machine addresses this issue by facilitating cooperation between a cutting mechanism and a metering device. The cutting mechanism and the metering device may cooperate such that the metering device appropriately times and positions the beaded substrate within the rod such that the cutting mechanism cuts the rod away from (e.g., separated from, a first distance from, a second distance from, etc.) the beaded substrate. The beaded substrate and the filler material may not be easily substituted back and forth as can be done for the small-batch rod wrapping machine disclosed in U.S. Pat. No. 7,537,013. The rod wrapping machine addresses the problem of uncontrolled or unevenly distributed beads throughout the rod by adding the beaded substrate to the rod such that the beaded substrate is timed, aligned, and disposed desirably within the finished smoking article. In some embodiments, the rod wrapping machine is able to be retrofitted onto an existing rod wrapping machine. In other embodiments, the rod wrapping machine is a standalone system configured to time, align, and dispose the beaded substrate within the rod to impede spillage of the beaded substrate.

Referring to FIG. 1, a rod wrapping machine 16 is shown. The rod wrapping machine 16 includes a tower portion 17, a chimney portion 18, and a suction conveyor system (e.g., suction conveyor belt, suction conveyor apparatus, suction conveyor device, etc.) 20. The tower portion 17 is disposed within the rod wrapping machine 16 and is configured to provide the chimney portion 18 with a source of the filler material 22. The chimney portion 18 is disposed within the rod wrapping machine 16 and configured to provide the suction conveyor system 20 with a source of the filler material 22.

The tower portion 17 includes a filler conveyor belt 25, a filler entry 27, a filler conduit 29, and a spreader belt 31. The filler conveyor belt 25 is configured to transfer the filler material 22 from the filler entry 27 to the filler conduit 29. The filler material 22 falls through the filler conduit 29 until the filler material 22 settles on the spreader belt 31. The spreader belt 31 then rotates toward the chimney portion 18, where the filler material is provided to the suction conveyor system 20.

The filler material 22 is biased toward the suction conveyor system 20 by an upwardly moving air stream 24. The air stream 24 moves generally from the chimney portion 18 toward the suction conveyor system 20, opposite gravity. The suction conveyor system 20 includes a belt (e.g., foraminous belt, porous belt, formable belt, conveyor belt, endless belt, etc.), shown as a belt 32. The belt 32 may be porous such that air, but not the filler material 22, can pass therethrough. The belt 32 is supported and driven by a first roller 36 and a second roller 38. The second roller 38 is opposite and downstream of the first roller 36.

The suction conveyor system 20 also includes a suction chamber (e.g., low pressure area, etc.) 41. The suction chamber 41 is disposed between the second roller 38 and the first roller 36, and is within (e.g., along) the belt 32. The suction chamber 41 is configured to attract and retain the filler material 22 against the bottom of the suction conveyor system 20. In some embodiments, the filler material 22 is located below the belt 32 in the chimney portion 18 such that the filler material 22 is pulled upward by the air stream 24 toward the belt 32. The upward pull by the air stream 24 forms the filler material 22 into a continuous stream (e.g., cake, pile, mass, stream, etc.), shown as a stream of filler material 44 (e.g., a stream 44, a stream 44 of filler material 22, etc.), such that the stream 44 forms on the underside of the belt 32. The belt 32 transports (e.g., conveys, moves, etc.) the stream 44 downstream (e.g., to the left) to be trimmed by an assembly of the rod wrapping machine 16.

Figure 2:
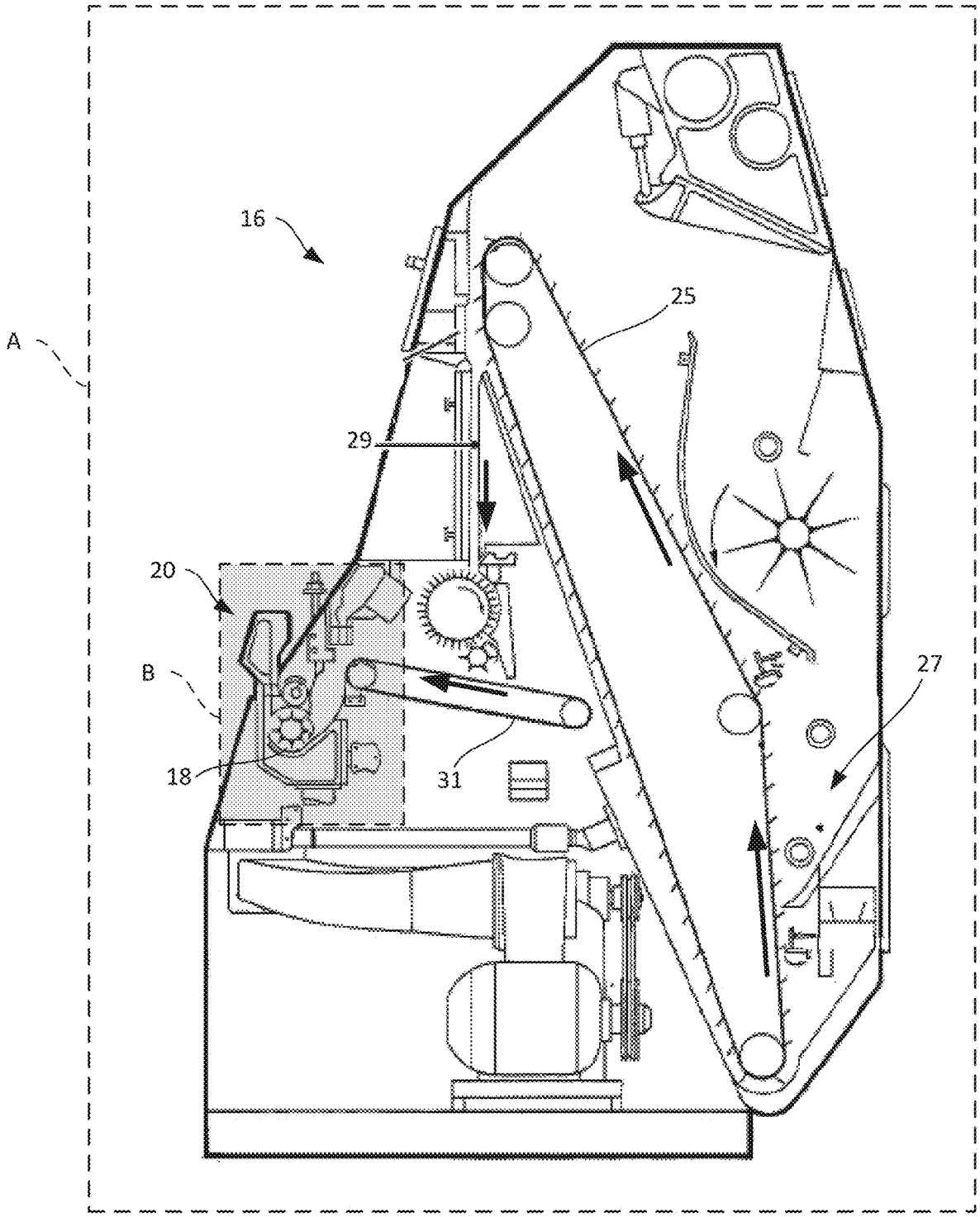
FIG. 2 is a cross-sectional side view of the system of FIG. 1.
Figure 3:
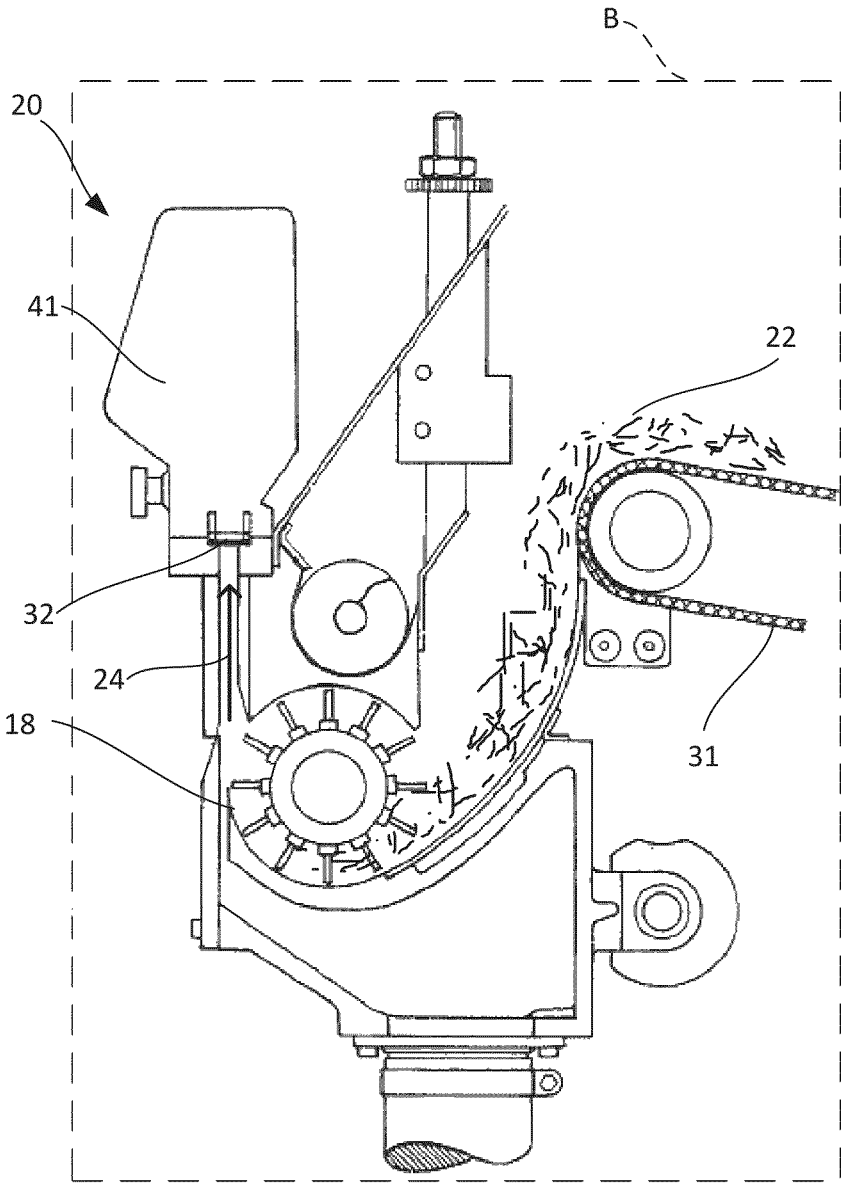
FIG. 3 is a cross-sectional side view of a portion of the system of FIG. 1.

Referring to FIG. 2, a side-view of rod wrapping machine 16 from view window A is shown. The arrows show the movement of the filler material 22 from the filler entry 27 to the spreader belt 31, and from the spreader belt 31 to the chimney portion 18. Within view window A is portion B, which is the right-most (e.g., upstream) end of the chimney portion 18 and the suction conveyor system 20. Referring to FIG. 3, an enlarged view of the suction conveyor system 20 from view window B is shown. The air stream 24, caused by the suction chamber 41, biases the filler material 22 from the chimney portion 18 and up toward the belt 32.

Figure 4:
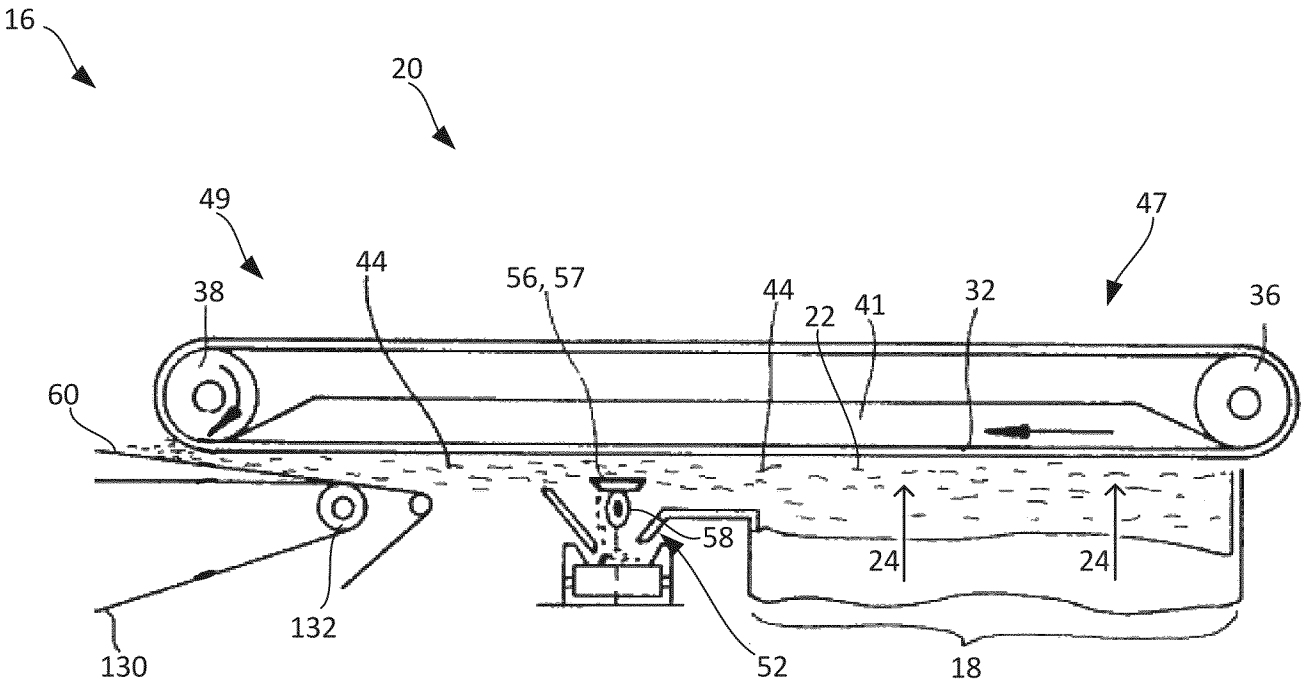
FIG. 4 is a cross-sectional front view of a suction conveyor system of the system of FIG. 1.

The suction conveyor system 20 also includes a first suction end (e.g., first belt end) 47 and a second suction end (e.g., second belt end) 49 disposed in a lateral direction away from and downstream of the first suction end 47, as shown in FIGS. 1 & 4. The first suction end 47 is upstream and opposite of the second suction end 49. The first suction end 47 includes the first roller 36 and the second suction end 49 includes the second roller 38. Relative to the orientation of FIG. 4, both the first roller 36 and the second roller 38 rotate clockwise such that the bottom portion of the belt 32 advances downstream.

The rod wrapping machine 16 also includes a trimming assembly 52. The trimming assembly 52 is disposed underneath a center portion of the suction conveyor system 20, proximate where the first suction end 47 and the second suction end 49 come together. The trimming assembly 52 assists in providing transfer of the appropriate amount of the filler material 22 downstream to a garniture portion 55 by trimming excess filler material 22 from the stream 44. The trimming assembly 52 includes a first disk 56, a second disk 57 proximate the first disk 56, and a separating wheel 58 below and proximate the first disk 56 and the second disk 57. The first disk 56, the second disk 57, and the separating wheel 58 cooperate to trim the stream 44 and assist in providing the appropriate amount of the filler material 22 downstream. The first disk 56 and the second disk 57 are provided with equidistant pockets whose purpose is to ensure that certain portions of the stream 44 contain more of the filler material 22 than the remaining portions. This is necessary if the rod wrapping machine 16 is to produce so-called dense-end cigarettes which reduce the likelihood of uncontrolled escape of the filler material 22 from open ends of the cut rods.

Referring to FIG. 1, a continuous web of paper wrapping material (e.g., paper belt, roll of paper webbing, etc.), shown as a paper web 60, is supplied from a roll (e.g., spool, etc.), shown as a bobbin 61. The bobbin 61 is supported and rotated using an assembly, shown as an unwind spindle assembly 62. The paper web 60 is routed on a desired path using a series of idler rollers and guideposts, shown as roller 63 and roller 64, through an optional printing assembly device 65, and ultimately-through the garniture portion 55.

The paper web 60 travels toward the garniture portion 55 of the rod wrapping machine 16. The garniture portion 55 includes a belt (e.g., endless formable garniture conveyor belt, etc.), shown as a garniture belt 130. That garniture belt 130 conveys the paper web 60 around a roller 132, underneath a finger rail assembly 140, and advances that paper web 60 over and through an entrance cone 144. The entrance cone 144 also extends beyond (e.g., downstream of) the finger rail assembly 140. The right end of the garniture belt 130 is positioned adjacent to and beneath the second suction end 49 in order that the filler material 22 carried by the belt 32 is deposited on the paper web 60. The finger rail assembly 140 and entrance cone 144 combine to provide a way to guide movement of the stream 44 from the belt 32 to the garniture portion 55. Selection and use of finger rail assemblies and garniture entrance cones will be readily apparent to those skilled in the art of smoking article manufacture.

As the belt 32 and stream 44 travel within the finger rail assembly 140, vacuum suction applied by the suction chamber 41 to the inside region of the belt 32 is released. As a result, the stream 44 is released from contact with the belt 32, falls downwardly from the belt 32 through a longitudinally extending track (not shown) within the finger rail assembly 140, and is deposited onto the paper web 60 below the second suction end 49 and immediately below the finger rail assembly 140. In conjunction with the release of vacuum from the belt 32 by the suction chamber 41, removal of the stream 44 from the belt 32, and deposit of the stream 44 onto the paper web 60, is facilitated through the use of a scrape 155. The scrape 155 is used to peel or otherwise physically remove the stream 44 from the outer surface of the extreme downstream end of the belt 32.

The garniture portion 55 includes a tongue 160 adjacent to the distal end of the finger rail assembly 140 and above the top surface of the garniture belt 130. The tongue 160 provides a commencement of constriction of the filler material 22 that has been deposited on the paper web 60. Meanwhile, the garniture belt 130 begins to form the stream 44 and the paper web 60 into a rod (e.g., continuous rod, endless rod, continuous paper rod, continuous aerosol rod, endless paper rod, etc.), shown as a continuous rod 170. The tongue 160 extends to a point where the paper web 60 is secured around the stream 44. The tongue 160 and the garniture belt 130 define a passage which progressively decreases in cross-section in the direction of movement of the stream 44 such that the stream 44 progressively forms a substantially circular cross-section that is desired for the ultimate finished continuous rod 170.

The garniture portion 55 also includes a mechanism, shown as a folding mechanism 180, on each side of the garniture belt 130 located adjacent to, and downstream of, the tongue 160. The folding mechanism 180 is aligned in the direction of the stream 44 movement, further compressing the stream 44 within the paper web 60 to create the continuous rod 170. The continuous rod 170 that exits the tongue 160 and folding mechanism 180 then passes through an adhesive applicator 184, in order that adhesive is applied to the exposed length or lap seam region of the paper web 60. That is, the exposed length of paper web 60 then is lapped onto itself, and the adhesive is set in that region in order to secure the paper web 60 around the filler material 22, thereby forming the continuous rod 170. The continuous rod 170 passes through a cutting mechanism (e.g., subdivision mechanism, knife mechanism, final knife, etc.), shown as a cutting mechanism 186. The cutting mechanism 186 is configured to cut the continuous rod 170 at a predetermined cut point to form a rod 190 of a desired length.

Figure 5:
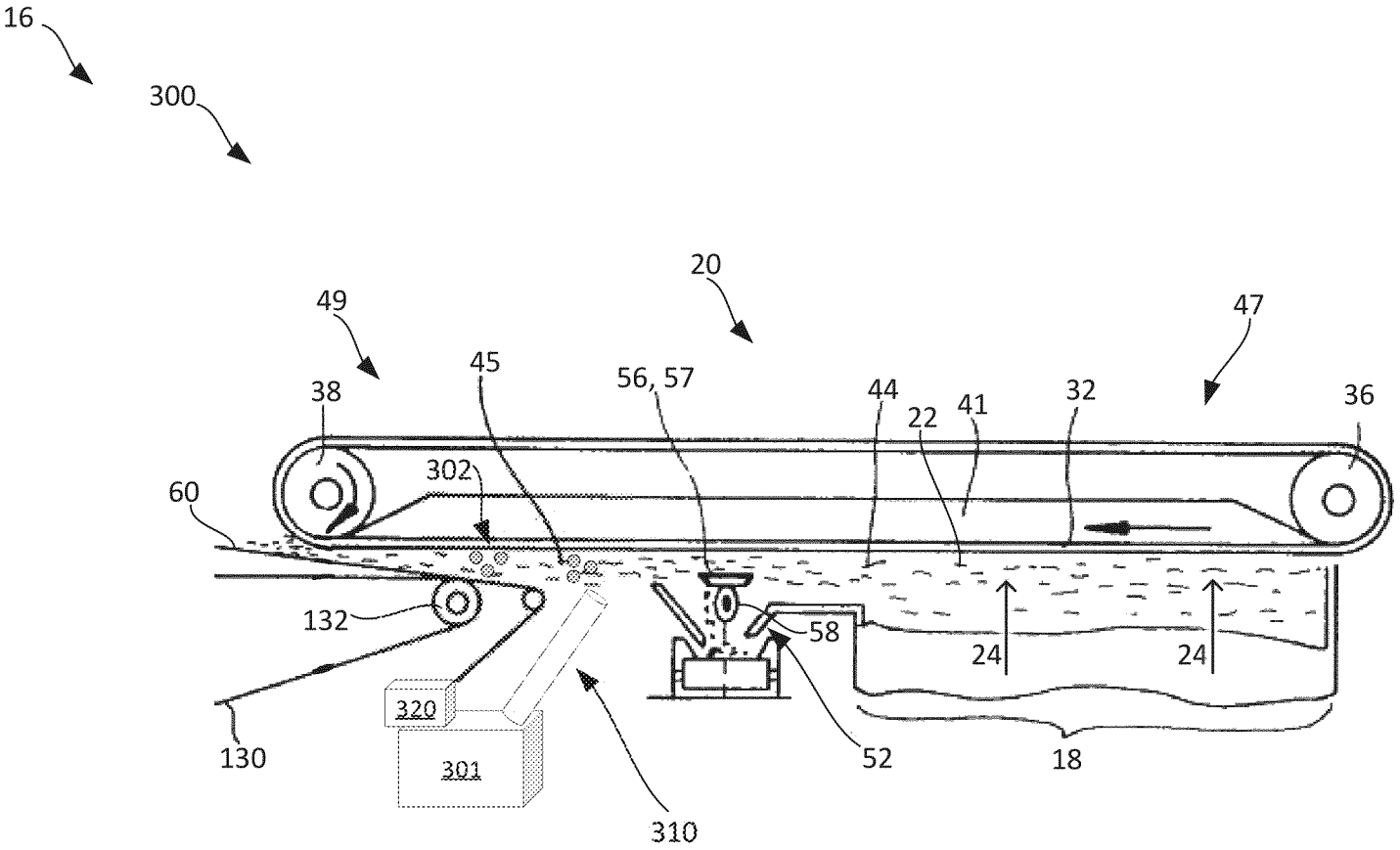
FIG. 5 is a cross-sectional front view of the suction conveyor system of FIG. 4, further including a metering device positioned downstream of a trimming assembly.

Referring to FIG. 5, a first embodiment of the bead portioning system 300 is shown. The bead portioning system 300 may be integrated within the rod wrapping machine 16. In some embodiments, the bead portioning system 300 may be retrofit to an existing rod wrapping machine 16. The bead portioning system 300 includes the suction conveyor system 20 and a metering device 301. The metering device 301 is positioned on the rod wrapping machine 16 and is structured to reach into the rod wrapping machine 16. In some embodiments, the metering device 301 is positioned within the rod wrapping machine 16.

The metering device 301 is structured to reach underneath the second suction end 49, downstream of the trimming assembly 52. Generally speaking, the metering device 301 is configured to dispose a substrate (e.g., additive, etc.), shown as a beaded substrate 302, into the stream 44, forming a stream of aerosol generating product components 45. Within the stream of aerosol generating product components 45, the beaded substrate 302 is disposed among the filler material 22. The stream of aerosol generating product components 45 is then wrapped in the paper web 60 and formed into the continuous rod 170. The beaded substrate 302 may include at least one bead, shown as a bead 303.

After the stream 44 has been trimmed by the trimming assembly 52, the stream 44 moves downstream, passing over and near the metering device 301. The metering device 301 is configured to present the beaded substrate 302 proximate the belt 32 such that the low pressure vacuum of the suction chamber 41 biases the beaded substrate 302 away from the metering device 301 and into the stream 44. The metering device 301 is then configured to release the beaded substrate 302 at predetermined intervals such that the beaded substrate 302 is disposed within the stream 44 at a desirable location, such as a location that will be separated from open cut ends of the rod (not shown in FIGS. 1 and 2). Upon introduction of the beaded substrate 302 within the stream 44, the stream of aerosol generating product components 45 is formed. In some embodiments, the release of the beaded substrate 302 from the metering device 301 is predetermined by an operator. In other embodiments, the metering device 301 may timely dispose a bead 303 into the stream 44 such that the bead 303 is disposed nearer a first cut end of the rod 190 relative to a second cut end of the rod 190.

The metering device 301 includes a reach 310 and a hopper 320. The reach 310 is configured to extend into the rod wrapping machine 16 and underneath the second suction end 49. The reach 310 is configured to present the beaded substrate 302 such that the suction conveyor system 20 may bias the beaded substrate 302 away from the reach 310 and toward the stream 44. There may be limited space between the trimming assembly 52 and the roller 132 such that only a portion of the metering device 301, such as the reach 310, may be positioned below the suction conveyor system 20 and downstream of the trimming assembly 52. In some embodiments, the reach 310 may be a screw drive. The screw drive may turn, quickly or slowly, such that a desired amount of the beaded substrate 302 may be presented to the stream 44 at any given time. In some embodiments, the metering device 301 may intermittently present the beaded substrate 302 to the second suction end 49 such that there may be intervals within the stream 44 that do not contain the beaded substrate 302 and intervals within the stream 44 that do contain the beaded substrate 302. In some embodiments, the metering device 301 may present the beaded substrate 302 to the second suction end 49 in very short intervals such that within the rod 190, the beaded substrate 302 is positioned at intervals. In some embodiments, the metering device 301 may present the beaded substrate 302 with large intervals in between, such that the rod 190 may not include any of the beaded substrate 302, but a subsequent rod 190 may include some of the beaded substrate 302.

In some embodiments, the reach 310 includes a tube. The tube may be a long or flexible tube able to extend into the rod wrapping machine 16 and present the beaded substrate 302 to the second suction end 49. The tube may include a series of pneumatics that bias the beaded substrate 302 toward the suction conveyor system 20.

Figure 6:
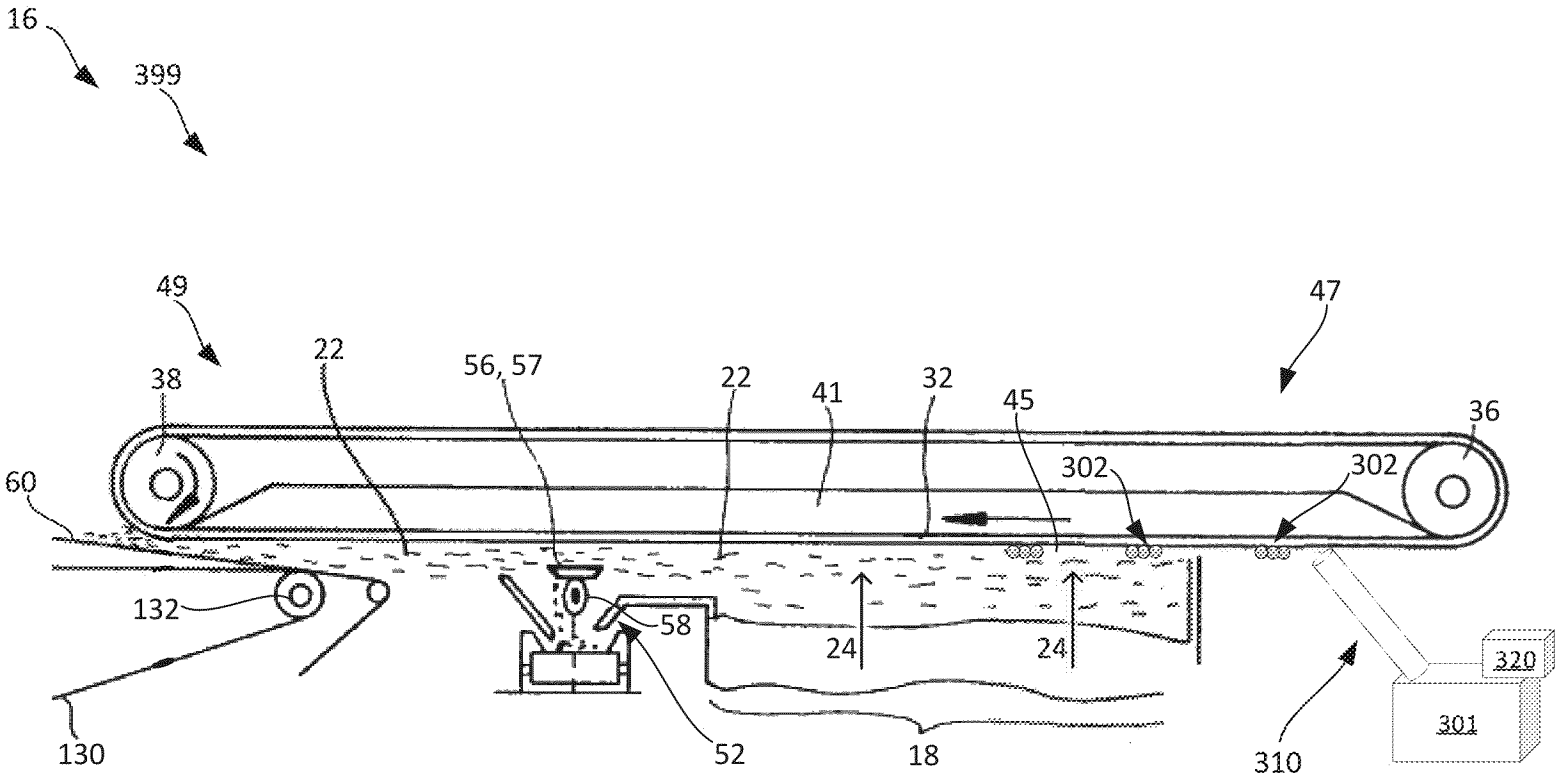
FIG. 6 is a cross-sectional front view of the suction conveyor system of FIG. 4, further including a metering device positioned upstream of a chimney portion.

Referring to FIG. 6, a bead portioning system 399, which is similar to the bead portioning system 300, is shown, according to an example embodiment. The bead portioning system 399 may be integrated within the rod wrapping machine 16. In some embodiments, the bead portioning system 399 may be retrofit to an existing rod wrapping machine 16. The bead portioning system 399 includes the suction conveyor system 20 and the metering device 301. A difference between the bead portioning system 300 and the bead portioning system 399 is the location of the metering device 301. In the bead portioning system 399, the metering device 301 is located under the first suction end 47, upstream of the chimney portion 18. In some embodiments, the first suction end 47, including both a portion of the suction chamber 41 and the first roller 36, is extended upstream of the chimney portion 18 such that the metering device 301 has an appropriate amount of clearance to operate. In some embodiments, the chimney portion 18 is shortened and narrowed to allow for clearance of the metering device 301. In other embodiments, the metering device 301 is disposed within the chimney portion 18. The metering device 301 is configured to dispose the beaded substrate 302 on the belt 32 before the filler material 22 from the chimney portion 18 is suctioned to the belt 32 by the suction chamber 41. In particular, the metering device 301 is configured to present the beaded substrate 302 proximate the belt 32 such that the low pressure vacuum of the suction chamber 41 biases the beaded substrate 302 away from the metering device 301 and onto the belt 32. The metering device 301 is configured to release of the beaded substrate 302 at predetermined intervals such that the beaded substrate 302 is disposed along the belt 32 at a desirable location, such as a location that will be separated from open cut ends of the rod. In some embodiments, the release of the beaded substrate 302 from the metering device 301 is predetermined by an operator. In other embodiments, the metering device 301 may timely dispose a bead 303 onto the belt 32 such that the bead 303 is disposed nearer a first cut end of the rod relative to a second cut end of the rod.

After the metering device 301 disposes the beaded substrate 302 on the underside of the belt 32, the belt 32 traverses over the chimney portion 18. Here, the suction chamber 41 inhales the filler material 22 to the underside of the belt 32 such that the beaded substrate 302 is disposed within the filler material 22. This forms the stream of aerosol generating product components 45. In some embodiments, the filler material 22 may not be present such that only a stream of the beaded substrate 302 is formed. This may be desirable in an embodiment where the rod 190 is filled entirely of only the beaded substrate 302.

In some embodiments, the reach 310 may be structured to release the beaded substrate 302 proximate the belt 32 after the filler material 22 is suctioned to the suction chamber 41. For example, the reach 310 may be structured to release the beaded substrate 302 between the filler material 22 and the belt 32 after the filler material 22 has already been suctioned to the belt 32 by the suction chamber 41. This may be desirable in some embodiments where the first suction end 47 cannot be extended upstream of the chimney portion 18.

In some embodiments, the reach 310 may be a screw drive. The screw drive may apply a force to the beaded substrate 302 such that the beaded substrate 302 may be disposed within the filler material 22 after the filler material 22 has been suctioned to the belt 32 by the suction chamber 41. The screw drive may turn, quickly or slowly, such that a desired amount of the beaded substrate 302 may be presented to the stream 44 at any given time. In some embodiments, the metering device 301 may intermittently present the beaded substrate 302 to the second suction end 49 such that there may be intervals within the stream 44 that do not contain the beaded substrate 302 and intervals within the stream 44 that do contain the beaded substrate 302. In some embodiments, the metering device 301 may present the beaded substrate 302 to the second suction end 49 in very short intervals such that within the rod 190, the beaded substrate 302 is positioned at intervals. In some embodiments, the metering device 301 may present the beaded substrate 302 with large intervals in between, such that the rod 190 may not include any of the beaded substrate 302, but a subsequent rod 190 may include some of the beaded substrate 302.

Figure 7:
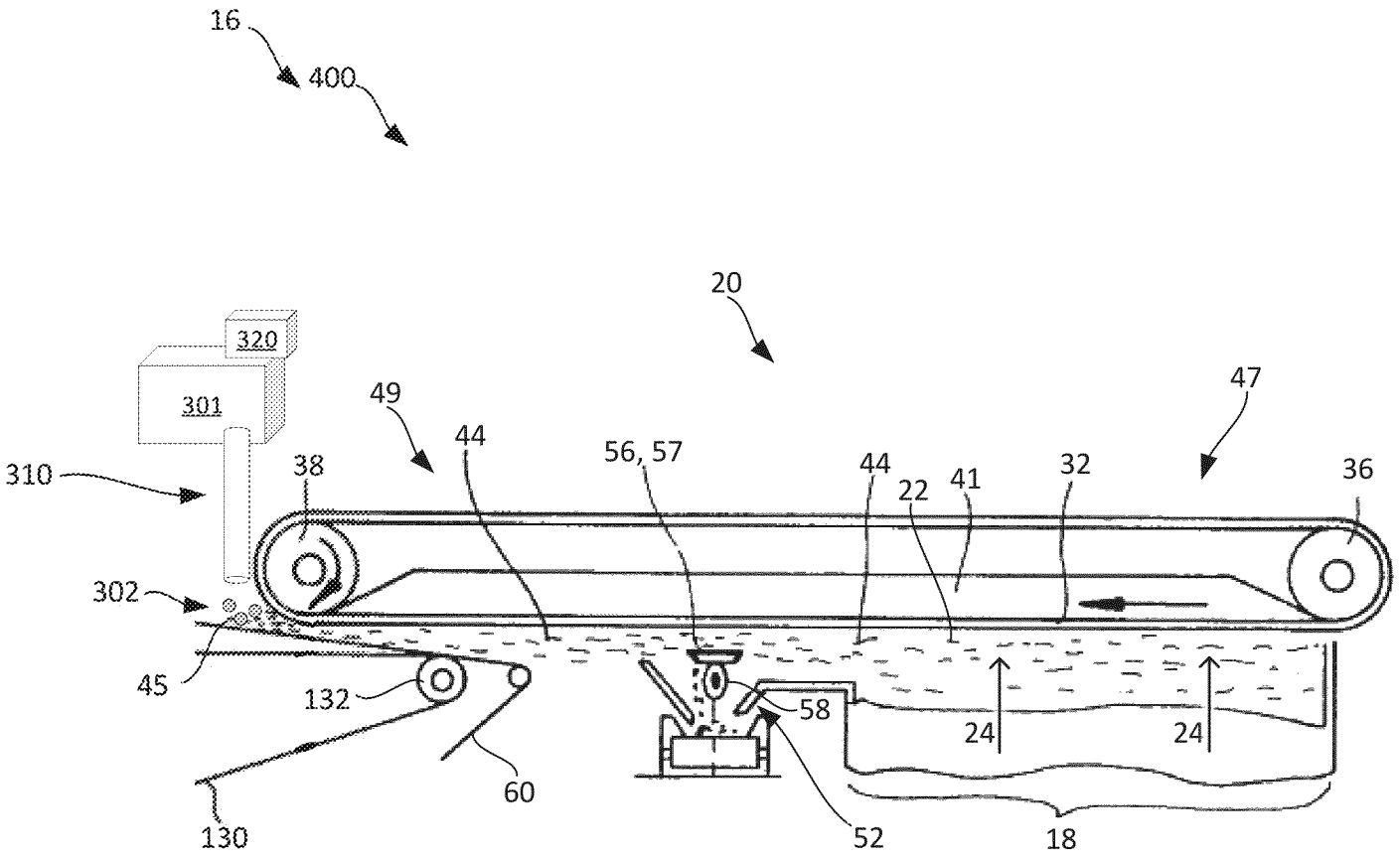
FIG. 7 is a cross-sectional front view of the suction conveyor system of FIG. 4, further including a metering device positioned downstream of the trimming assembly.

Referring to FIG. 7, a bead portioning system 400, which is similar to the bead portioning system 300, is shown. A difference between the bead portioning system 399 and the bead portioning system 400 is that the bead portioning system 400 drops the beaded substrate 302 into the stream 44 downstream of the suction conveyor system 20. The bead portioning system 400 may be integrated within the rod wrapping machine 16. In some embodiments, the bead portioning system 400 may be retrofit to an existing rod wrapping machine 16.

The bead portioning system 400 includes the suction conveyor system 20 and the metering device 301. The metering device 301 is configured to release the beaded substrate 302 such that it falls down and lands either on the paper web 60 or within the stream 44. The metering device 301 may be configured to dispose the beaded substrate 302 onto the paper web 60 just before the stream 44 is disposed on the paper web 60 by the suction conveyor system 20. In some embodiments, the metering device 301 disposes the beaded substrate 302 into the stream 44 at the same instance that the suction conveyor system 20 disposes the stream 44 onto the paper web 60. In some embodiments, the metering device 301 disposes the beaded substrate 302 within the stream 44 after the stream 44 has been disposed on the paper web 60 by the suction conveyor system 20.

The metering device 301 may be disposed within the rod wrapping machine 16 and located downstream of the suction conveyor system 20 and above the paper web 60. In some embodiments, the metering device 301 is positioned outside of the rod wrapping machine 16, and only the reach 310 is structured to extend into the rod wrapping machine 16. The metering device 301 may drop the beaded substrate 302 onto the stream 44 from above, forming the stream of aerosol generating product components 45 to be wrapped in the paper web 60. In some embodiments, the metering device 301 drops the beaded substrate 302 onto the paper web 60 from above. In some embodiments, the beaded substrate 302 includes an adhesive to aid in securing the beaded substrate 302 to the stream 44 or the paper web 60 when being dropped from above. In some embodiments, the paper web 60 includes an adhesive substrate to help secure the beaded substrate 302 to the paper web 60. The metering device 301 may include an air nozzle that biases the beaded substrate 302 away from the metering device 301 and toward the paper web 60 or stream 44. In some embodiments, the metering device 301 is positioned above the finger rail assembly 140 and configured to release the beaded substrate 302 into the finger rail assembly 140 to assist in directing the beaded substrate 302 toward the paper web 60 or stream 44. In some embodiments, the stream 44 is released from the suction conveyor system 20 and enters the finger rail assembly 140 at the same time that the metering device 301 releases the beaded substrate 302 into the finger rail assembly 140. This forms the stream of aerosol generating product components 45 before either the filler material 22 or the beaded substrate 302 reach the paper web 60. In some embodiments, the longitudinally extending track of the finger rail assembly 140 is used to direct the beaded substrate 302 onto the paper web 60.

The metering device 301 is configured to release of the beaded substrate 302 at predetermined intervals such that the beaded substrate 302 is disposed within the stream 44 at a desirable location, such as a location that will be separated from open cut ends of the rod. In some embodiments, the release of the beaded substrate 302 from the metering device 301 is predetermined by an operator. In other embodiments, the metering device 301 may timely dispose a bead 303 into the stream 44, forming the stream of aerosol generating product components 45, such that the bead 303 is disposed nearer a first cut end of the rod 190 relative to a second cut end of the rod 190.

In some embodiments, the reach 310 may be a screw drive. The screw drive may turn quickly or slowly, such that a desired amount of the beaded substrate 302 may be presented to the stream 44 at any given time. In some embodiments, the metering device 301 may intermittently present the beaded substrate 302 to the stream 44 such that there may be intervals within the stream 44 that do not contain the beaded substrate 302 and intervals within the stream 44 that do contain the beaded substrate 302. In some embodiments, the metering device 301 may present the beaded substrate 302 to the stream 44 in very short intervals such that within the rod 190, the beaded substrate 302 is positioned at intervals. In some embodiments, the metering device 301 may present the beaded substrate 302 with large intervals in between, such that the rod 190 may not include any of the beaded substrate 302, but a subsequent rod 190 may include some of the beaded substrate 302. In some embodiments, the reach 310 is a flexible tube that relies on gravity to move the beaded substrate 302 from the metering device 301 to the stream 44. As the tube may be flexible, the exit of the tube may be positioned in tight spaces. In some rod wrapping machines 16, there is very little space downstream of the suction chamber 41. In such embodiments, it may be desirable that the metering device 301 be positioned outside of the rod wrapping machine 16 and only the reach 310 be structured to extend into the rod wrapping machine 16, downstream of the suction chamber 41, and above the paper web 60. Thus the metering device 301 may overcome the space constraints that often create a challenge for such placement of a metering device, such as the metering device 301.

Figure 8:
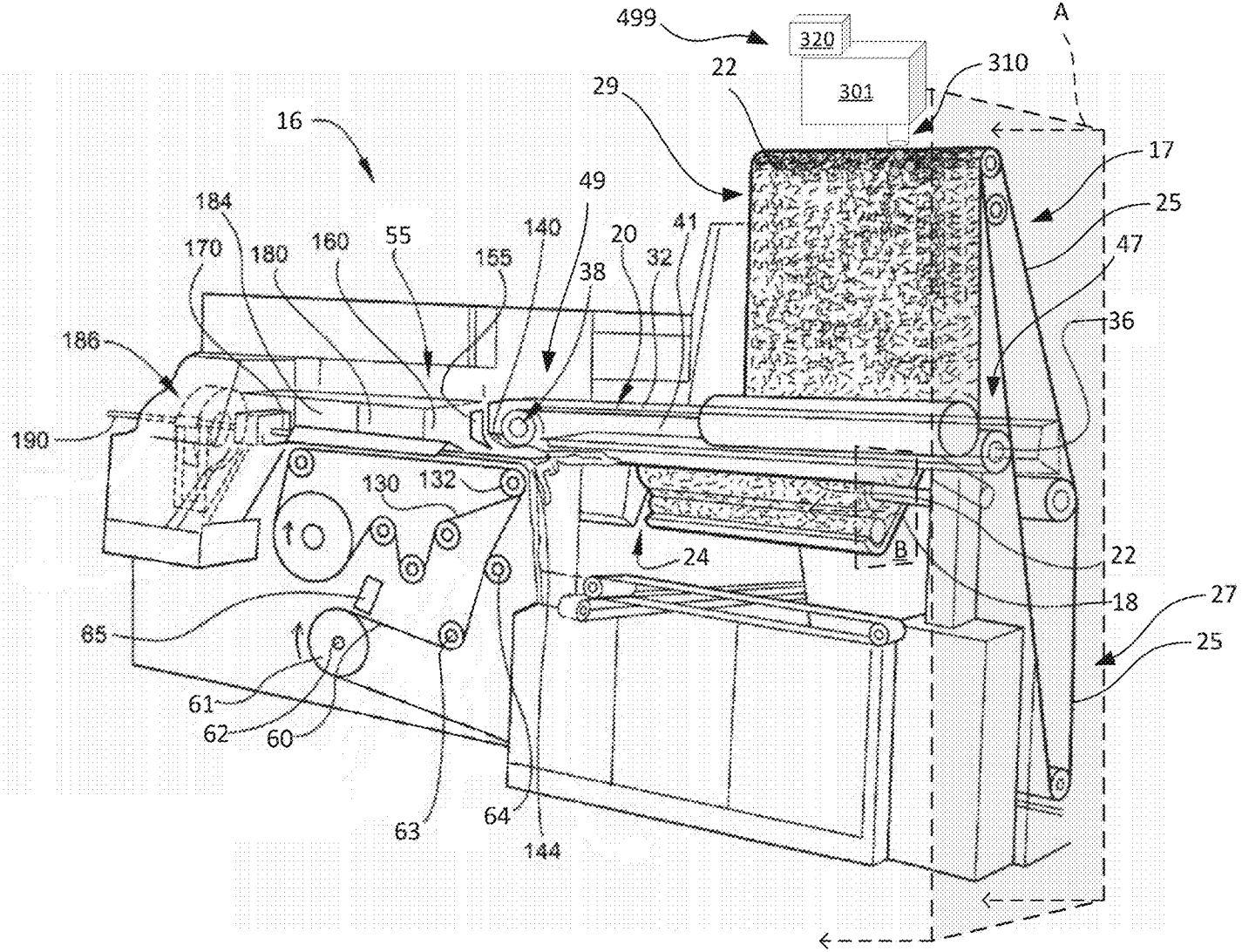
FIG. 8 is perspective view of the system of FIG. 1, further including a metering device positioned above a tower portion.

Referring to FIG. 8, a bead portioning system 499 is shown. The bead portioning system 499 includes the metering device 301 positioned above the tower portion 17 and configured to position the beaded substrate 302 within the filler material 22 before the filler material 22 enters the filler conduit 29.

The bead portioning system 499 may be integrated within the rod wrapping machine 16. In some embodiments, the bead portioning system 400 may be retrofit to an existing rod wrapping machine 16. In some embodiments, the metering device 301 may be positioned outside of the rod wrapping machine 16, and outside of the tower portion 17. The metering device 301 may be structured such that the reach 310 extends into the rod wrapping machine 16 and proximate the filler material 22 just before the filler material 22 enters the filler conduit 29. The metering device 301 may release the beaded substrate 302 through the reach 310 and into the filler material 22. In some embodiments, the beaded substrate 302 and the filler material 22 mix together as they travel through the filler conduit 29 and toward the chimney portion 18. Thus, when the stream 44 is finally wrapped in the paper web 60, the beaded substrate 302 is evenly distributed throughout the rod 190. In some embodiments, the metering device 301 may present the beaded substrate 302 at intervals such that the beaded substrate 302 is not evenly distributed throughout the rod 190. The metering device 301 may deposit the beaded substrate 302 at a first flow rate for a first time interval, and then stop depositing the beaded substrate 302 for a second interval, and then repeat the pattern for a length of time necessary until a desired amount of rods (e.g., the rod 190) are manufactured. Such a pattern may be followed by any of the bead portioning systems described above and herein.

In some embodiments, the reach 310 may extend into the filler conduit 29 from above. This may increase the accuracy of the positon of the beaded substrate 302 within the filler material. Eventually, the mixture of the filler material 22 and the beaded substrate 302 enters the chimney portion 18 and is suctioned to the belt 32, trimmed by the trimming assembly 52, and wrapped in the paper web 60.

Figure 9:
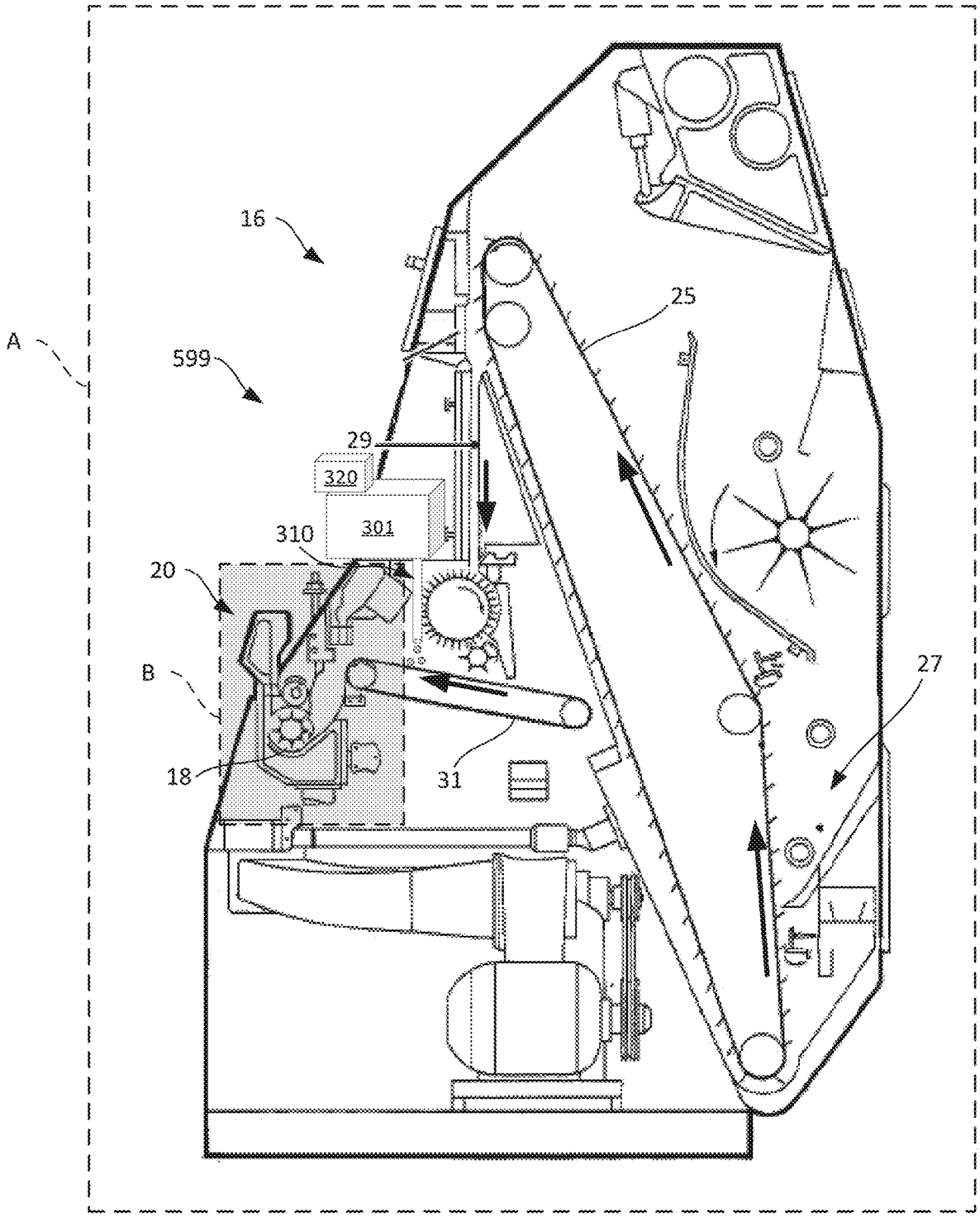
FIG. 9 is a cross-sectional side view of the system of FIG. 1, further including a metering device positioned above a spreader belt.

Referring to FIG. 9, a bead portioning system 599 is shown. The bead portioning system 599 includes the metering device 301 positioned above the spreader belt 31 and configured to deposit the beaded substrate 302 within the filler material 22 on the spreader belt 31 before the filler material 22 enters the chimney portion 18.

The metering device 301 may be positioned outside of the rod wrapping machine 16 and mounted to a flat, external surface. The reach 310 may extend into the rod wrapping machine 16 and proximate the spreader belt 31. The spreader belt 31 is positioned below the filler conduit 29 and is configured to assist in moving the filler material 22 from the filler conduit 29 to the chimney portion 18. The reach 310 may extend into the filler material 22 on the spreader belt 31 such that the beaded substrate 302 is mixed in with the filler material. In some embodiments, the metering device 301 drops the beaded substrate 302 onto the spreader belt 31 from above.

In some embodiments, the reach 310 may comprise a screw drive. The screw drive may turn, quickly or slowly, such that a desired amount of the beaded substrate 302 may be presented to the spreader belt 31, and thus the filler material 22, at any given time. In some embodiments, the metering device 301 may intermittently present the beaded substrate 302 to the spreader belt 31 such that there may be intervals within the filler material 22 that do not contain the beaded substrate 302 and intervals within the filler material 22 that do contain the beaded substrate 302. In some embodiments, the metering device 301 may present the beaded substrate 302 to the spreader belt 31 in very short intervals such that within the rod 190, the beaded substrate 302 is positioned at intervals. In some embodiments, the metering device 301 may present the beaded substrate 302 with large intervals in between, such that the rod 190 may not include any of the beaded substrate 302, but a subsequent rod 190 may include some of the beaded substrate 302.

In some embodiments, the reach 310 includes a tube. The tube may be a long or flexible tube able to extend into the rod wrapping machine 16 and present the beaded substrate 302 to the spreader belt 31. The tube may include a series of pneumatics that bias the beaded substrate 302 toward the spreader belt 31.

Figure 10A:
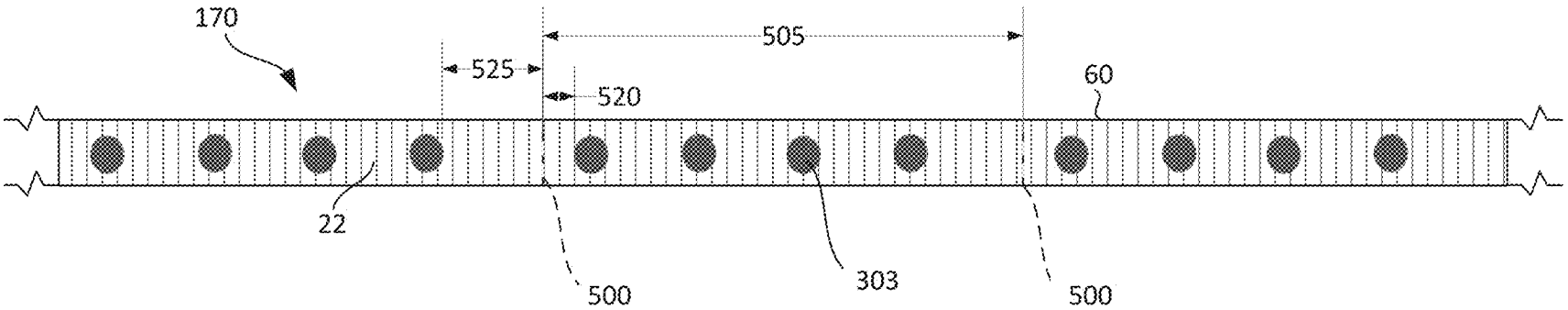
FIG. 10A is a cross-sectional view of a continuous rod with a beaded substrate, according to an example embodiment.

Referring to FIG. 10A, a cross-sectional view of the continuous rod 170 is shown, according to an example embodiment. During the cutting of the continuous rod 170 by the cutting mechanism 186, the rod 190 may be cut to various lengths appropriate for the length used in a smoking article. In some embodiments, the rod 190 is cut to a length of approximately 80 mm (e.g., 75 mm-85 mm). The cutting mechanism 186 is timed such that a cut is a distance away from where the beaded substrate 302 is disposed within the rod 190. The cut is made such that the beaded substrate 302 does not fall out of the rod 190.

Figure 10B:
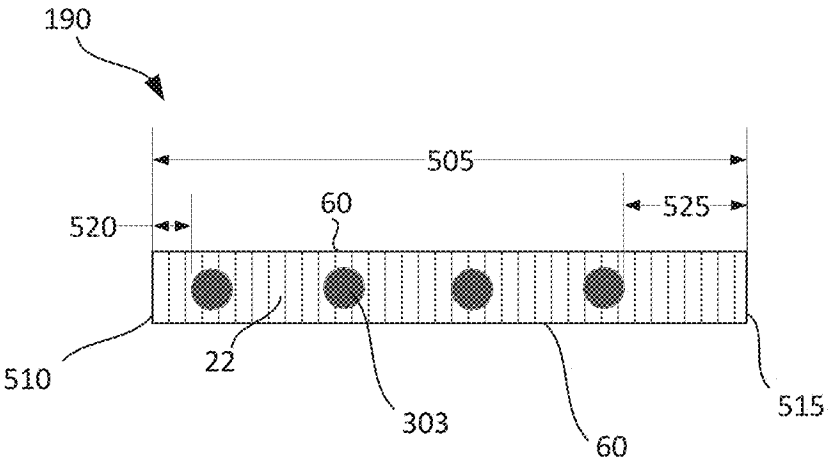
FIG. 10B is a cross-sectional view of a portion of the continuous rod of FIG. 10A.

The continuous rod 170 includes, disposed within the paper web 60 and the filler material 22, the beaded substrate 302. The continuous rod 170 is cut by the cutting mechanism 186 at a point (e.g., target, line, position, etc.), shown as a cut point 500. A distance from the cut point 500 to the next cut point 500 is shown as a rod length 505. The rod length 505 is also the length of the rod 190. Turning to FIG. 10B, the rod 190 of the rod length 505 is shown. The rod 190 has two ends, shown as a first end 510 and a second end 515. The first end 510 is opposite of the second end 515. Within the rod 190 may be the beaded substrate 302. The beaded substrate 302 is disposed a distance from the first end 510, shown as a first distance 520. The first distance 520 is measured from the first end 510 to a left-most edge of the beaded substrate 302. In some embodiments, the first distance 520 is between 10-15 mm. The beaded substrate 302 may also be disposed within the rod 190 a distance from the second end 515, shown as a second distance 525. The second distance 525 is measured from the second end 515 to a right-most edge of the beaded substrate 302.

In some embodiments, the cutting mechanism 186 may communicate with the metering device 301 to cut the continuous rod 170 away from where the beaded substrate 302 is positioned. For example, it may take 4 seconds for the bead 303 released from the metering device 301 to reach the cutting mechanism 186. When the metering device 301 releases the bead 303, the metering device 301 may send a signal to the cutting mechanism 186 that the bead 303 is moving toward the cutting mechanism 186. The cutting mechanism 186 may receive the signal and be anticipating the bead 303 to arrive. If the cutting mechanism is programmed to cut the rod 190 such that the bead 303 is positioned 10 mm away from the cut end, then the cutting mechanism may know to make a cut 4.01 seconds after the metering device 301 releases the bead 303. The metering device 301 and the cutting mechanism 186 can cooperate and be programmed to achieve these cuts at a rate of 4000 per minute, where each rod may include between 0 and 100 beads (e.g., the beaded substrate 302, the bead 303, etc.).

Figure 11:
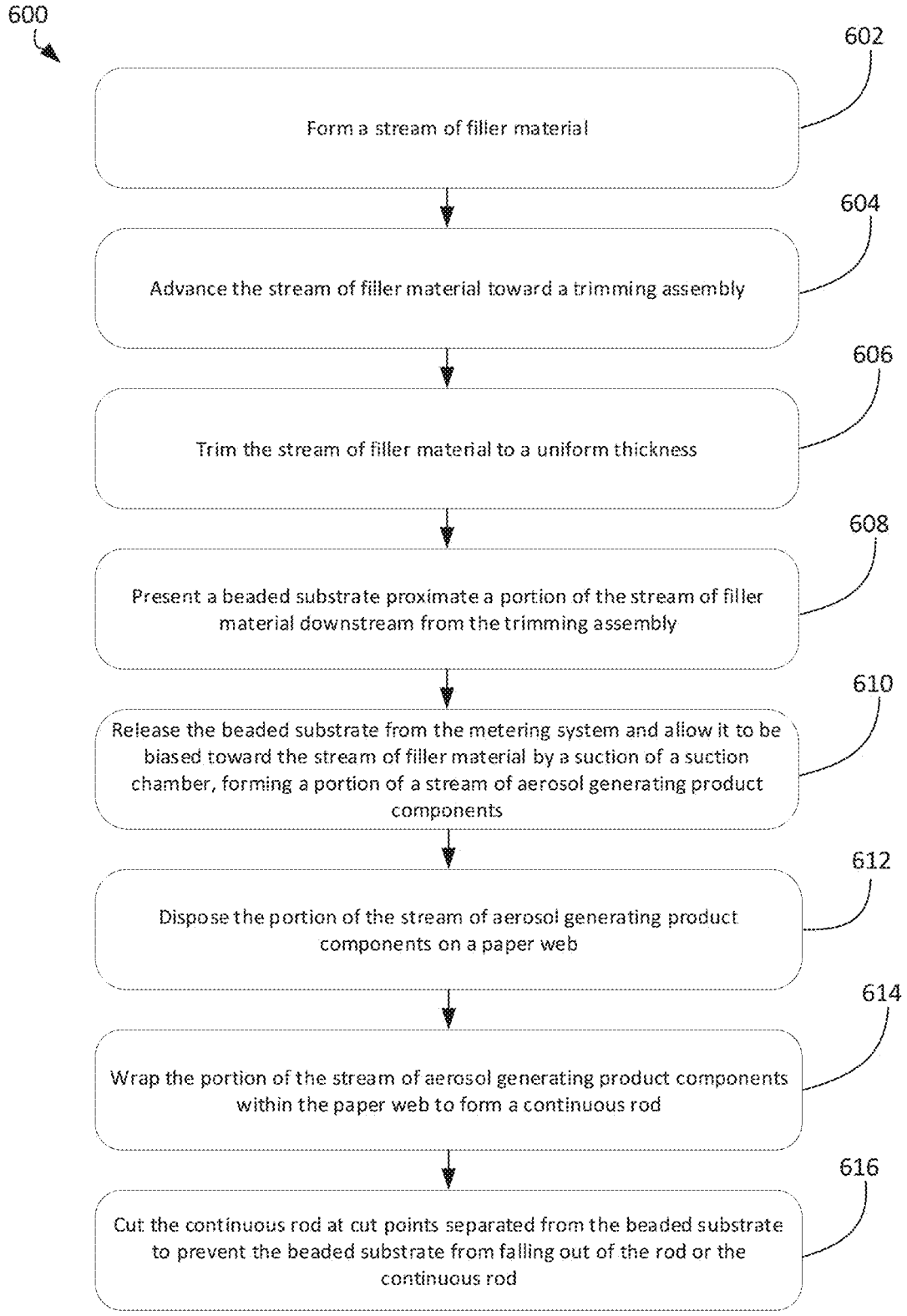
FIG. 11 is a schematic flow diagram of a method for manufacturing a rod with a beaded substrate disposed within, according to an example embodiment.

Referring to FIG. 11, a method 600 for manufacturing a rod 190 is shown. The method 600 generally uses the method of adding the beaded substrate 302 using the metering device 301 disclosed above. At 602, the stream of filler material 44 is formed. The stream 44 may be formed by the suction chamber 41 in cooperation with the belt 32 to bias the filler material 22 from the chimney portion 18.

At 604, the stream 44 is advanced toward the trimming assembly 52. In some embodiments, the stream 44 is disposed on the underside of the belt 32, held there by the suction chamber 41, and advanced by the second roller 38 and the first roller 36.

At 606, the stream 44 is trimmed to a uniform thickness appropriate for the reminder of the manufacturing of the continuous rod 170.

At 608, after the stream 44 is trimmed, the metering device 301 presents the beaded substrate 302 proximate to the stream 44. The beaded substrate 302 may be presented at predetermined time intervals or predetermined distance intervals relative to the speed and timing of the belt 32 and the cutting mechanism 186.

At 610, the metering device 301 releases the beaded substrate 302 such that the suction chamber 41 is able to bias the beaded substrate 302 from the metering device 301 and toward the belt 32 to dispose the beaded substrate 302 within the stream 44. In some embodiments, the beaded substrate 302 and the filler material 22 mix to form the stream of aerosol generating product components 45. In other embodiments, the beaded substrate 302 is portioned within the stream of filler material 44 at predetermined intervals by the metering device 301, the metering device 301 cooperating with the cutting mechanism 186 to position the beaded substrate 302 separated from the cut ends of the rod 190. The suction chamber 41 is always creating a vacuum, leaving the action of 'metering' (e.g., timing, presenting, releasing, etc.) the beaded substrate 302 to the metering device 301.

At 612, the stream of aerosol generating product components 45 is disposed on the paper web 60. The stream 44 of aerosol generating product components 45 falls from the belt 32 once the suction chamber 41 is no longer operative, such as when the belt 32 advances beyond the suction chamber 41. The stream of aerosol generating product components 45 falls onto the paper web 60 with guidance from the finger rail assembly 140 and the longitudinally extending track of the finger rail assembly 140.

At 614, the stream 44 of aerosol generating product components 45 is wrapped in the paper web 60, forming the continuous rod 170. The continuous rod 170 advances toward the cutting mechanism 186.

At 616, the continuous rod 170 is cut at predetermined cut points by the cutting mechanism 186. In some embodiments, the cutting mechanism 186 cooperates with the belt 32, the garniture belt 130, and the metering device 301 to decide where to cut such that the beaded substrate 302 will not fall out of the rod 190 or the continuous rod 170.

Figure 12:
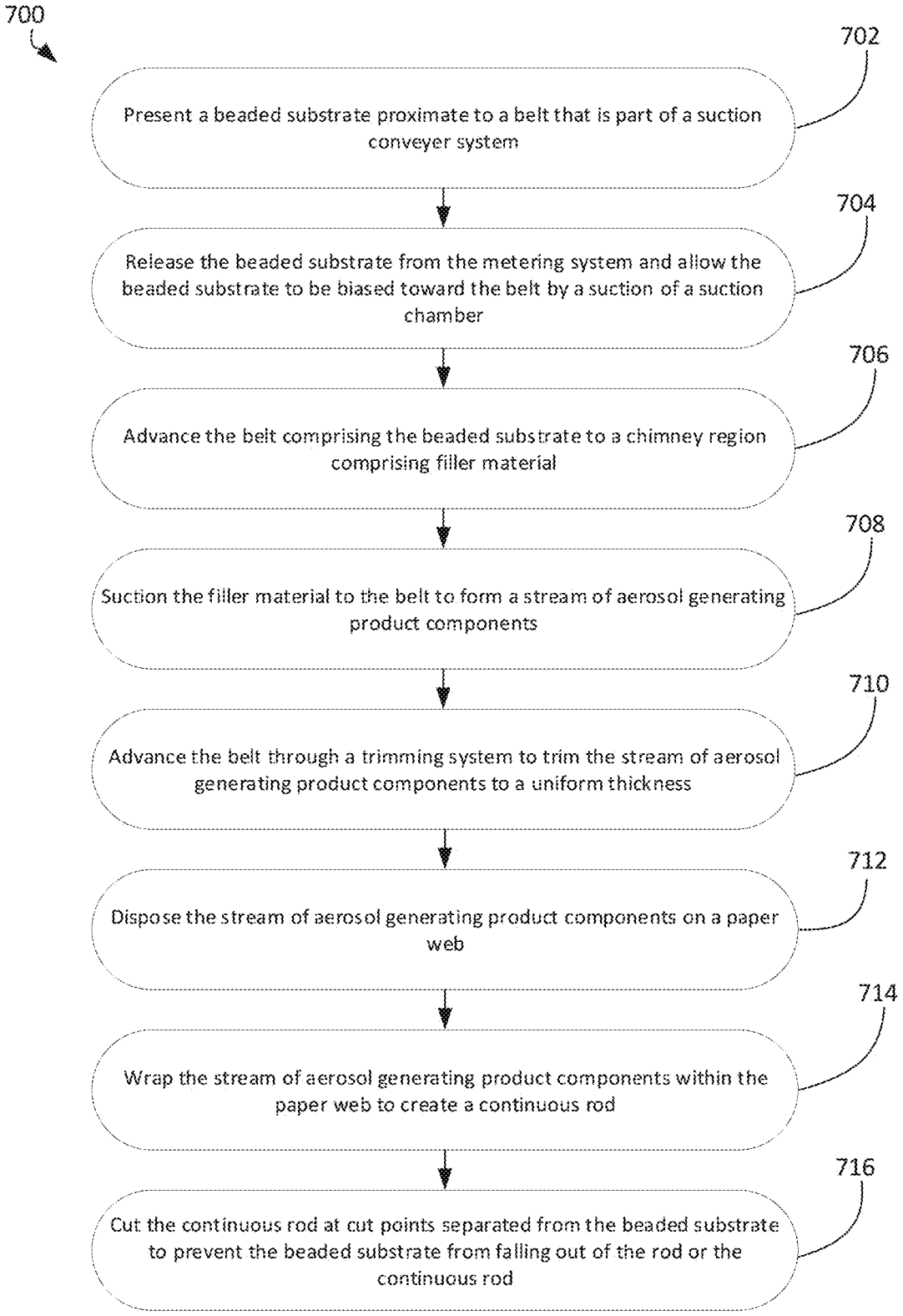
FIG. 12 is a schematic flow diagram of a method for manufacturing a rod with a beaded substrate disposed within, according to another example embodiment.

Turning to FIG. 12, another method 700 for manufacturing a rod 190 is shown. The method 700 relates generally to the metering device 301 positioned under the suction conveyor system 20 upstream of the chimney portion 18. At 702, the metering device 301 presents the beaded substrate 302 proximate the belt 32. The metering device 301 presents the beaded substrate 302 at predetermined time intervals or predetermined distance intervals. In some embodiments, the metering device 301 presents one bead 303 at a time. In other embodiments, the metering device 301 presents more than one bead 303 at one time.

At 704, the metering device 301 releases the beaded substrate 302 such that the suction chamber 41 is able to bias the beaded substrate 302 away from the metering device 301 and toward the belt 32. As a result, the beaded substrate 302 is disposed on the belt 32 before any of the filler material 22 is disposed on the belt.

At 706, the belt 32 advances toward the chimney portion 18, the chimney portion 18 having the filler material 22 waiting to the lifted up to the belt 32.

At 708, the suction chamber 41 inhales up the filler material 22 from the chimney portion 18 and disposes it on the belt 32 among the beaded substrate 302 already disposed on the belt 32. This forms the stream 44 of aerosol generating product components 45. In some embodiments, the beaded substrate 302 says anchored in its position relative to the belt 32, being portioned within the stream of filler material 44 such that the beaded substrate 302 will be separated from the cut ends of the rod 190. In some embodiments, the filler material 22 is absent from the chimney portion 18, advancing a stream of the beaded substrate.

At 710, the belt 32 advances toward the trimming assembly 52 which trims the stream of aerosol generating product components 45 to a uniform thickness that is appropriate for the rest of the manufacturing process.

At 712, the stream of aerosol generating product components 45 is disposed on the paper web 60. The stream of aerosol generating product components 45 falls from the belt 32 once the suction chamber 41 is no longer operative, such as when the belt 32 advances beyond the suction chamber 41. The stream of aerosol generating product components 45 falls onto the paper web 60 with guidance from the finger rail assembly 140 and the longitudinally extending track of the finger rail assembly 140.

At 714, the stream of aerosol generating product components 45 is wrapped in the paper web 60, forming the continuous rod 170. The continuous rod 170 advances toward the cutting mechanism 186.

At 716, the continuous rod 170 is cut at predetermined cut points by the cutting mechanism 186. In some embodiments, the cutting mechanism 186 cooperates with belt 32, garniture belt 130, and metering device 301 to decide where to cut such that the beaded substrate 302 will not fall out of the rod 190 or the continuous rod 170.

Figure 13:
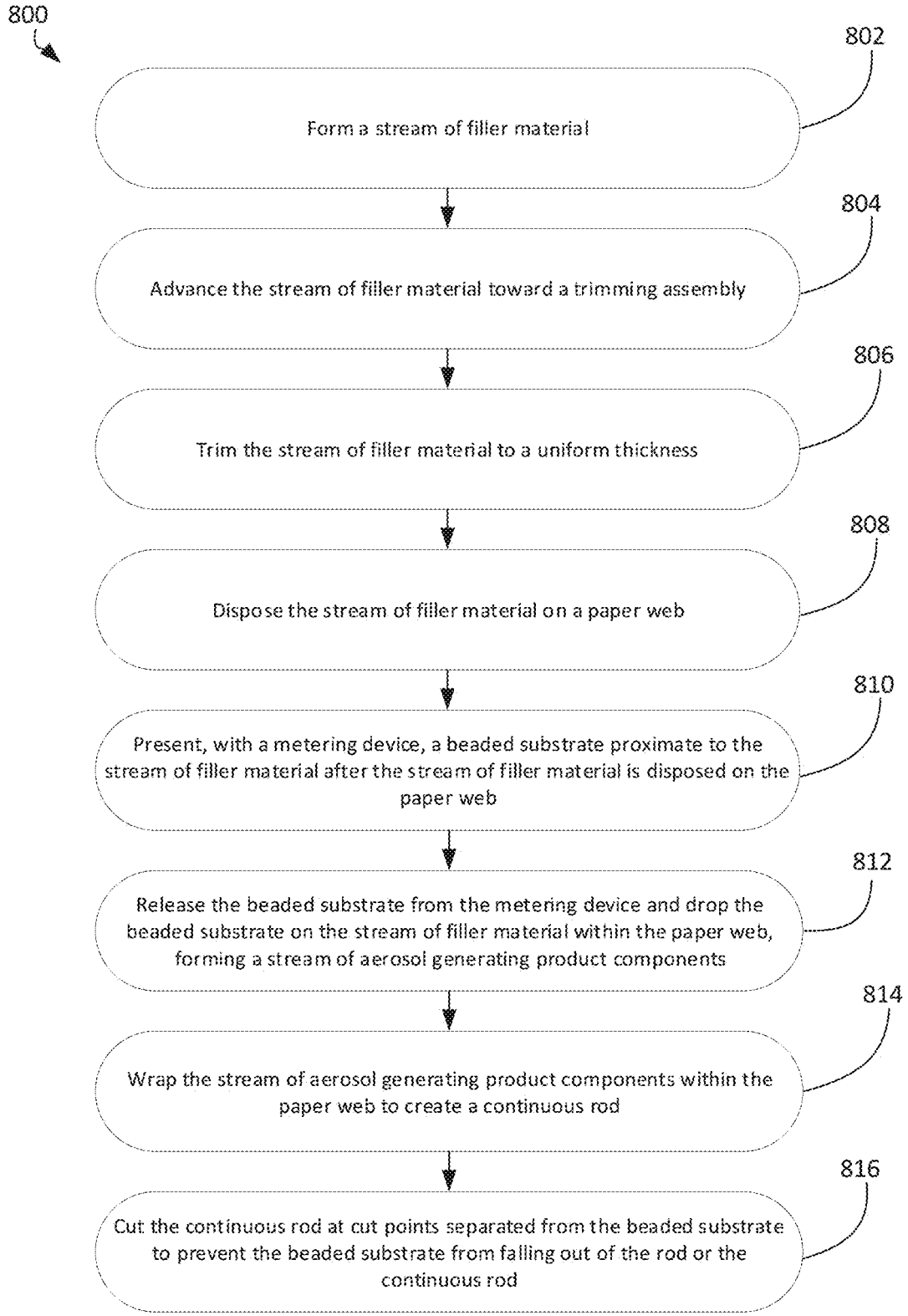
FIG. 13 is a schematic flow diagram of a method for manufacturing a rod with a beaded substrate disposed within, according to yet another example embodiment.

Referring to FIG. 13, yet another method for manufacturing a rod 190 is shown as a method 800. The method 800 relates most generally to the metering device 301 disclosed above, disposed above the paper web 60 downstream of the suction conveyor system 20. At 802, the stream 44 is formed. The stream 44 may be formed by the suction chamber 41 in cooperation with the belt 32 to suck the filler material 22 from the chimney portion 18.

At 804, the stream 44 is advanced toward the trimming assembly 52. In some embodiments, the stream 44 is disposed on the underside of the belt 32, held there by the suction chamber 41, and advanced by the second roller 38 and the first roller 36.

At 806, the stream 44 is trimmed to a uniform thickness appropriate for the reminder of the manufacturing of the continuous rod 170.

At 808, the stream 44 is disposed on the paper web 60. The stream 44 falls from the belt 32 once the suction chamber 41 is no longer operative, such as when the belt 32 advances beyond the suction chamber 41. The stream 44 falls onto the paper web 60 with guidance from the finger rail assembly 140 and the longitudinally extending track of the finger rail assembly 140.

At 810, the metering device 301 presents the beaded substrate 302 proximate to the stream 44 disposed on the paper web 60. The beaded substrate 302 may be presented at predetermined time intervals or predetermined distance intervals relative to the speed and timing of the belt 32.

At 812, the metering device 301 releases the beaded substrate 302 such that the beaded substrate 302 drops into the stream 44, forming the stream of aerosol generating product components 45 disposed on the paper web 60. In some embodiments, the beaded substrate 302 is dropped by the metering device 301 and guided to the stream 44 on the paper web 60 by the finger rail assembly 140 and the longitudinally extending track of the finger rail assembly 140.

At 814, the stream of aerosol generating product components 45 is wrapped in the paper web 60, forming the continuous rod 170. The continuous rod 170 advances toward the cutting mechanism 186.

At 816, the continuous rod 170 is cut at predetermined cut points by the cutting mechanism 186. In some embodiments, the cutting mechanism 186 cooperates with belt 32, garniture belt 130, and metering device 301 to decide where to cut such that the beaded substrate 302 will not fall out of the rod 190 or the continuous rod 170.

Figure 14:
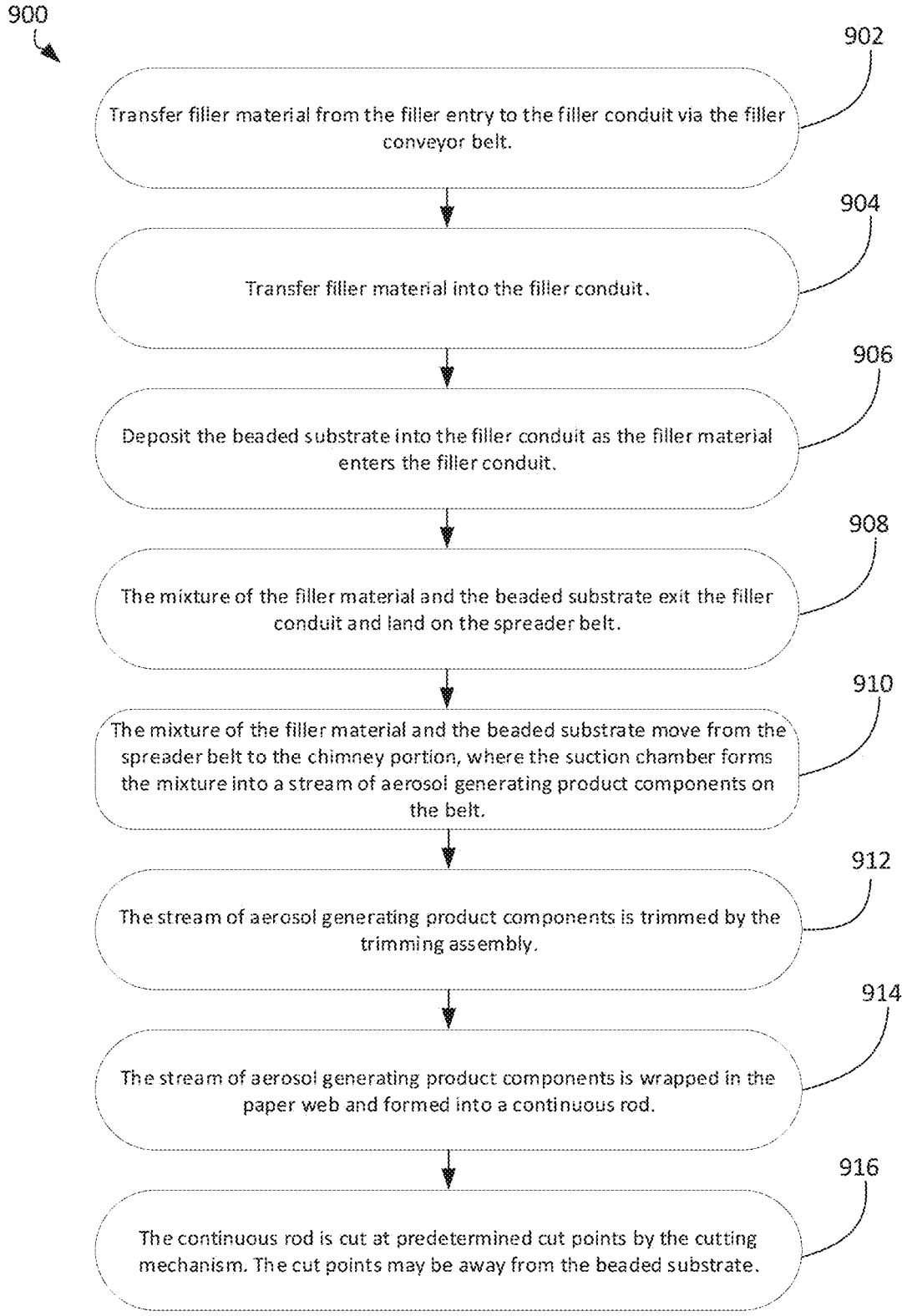
FIG. 14 is a schematic flow diagram of a method for manufacturing a rod with a beaded substrate disposed within, according to yet another example embodiment.

Referring to FIG. 14, yet another method for manufacturing a rod 190 is shown as a method 900. The method 900 relates most generally to the metering device 301 disclosed above, disposed above the tower portion 17 and above the filler conduit 29. At 902, the filler material 22 is transferred from the filler entry 27 toward the filler conduit 29 by the filler conveyor belt 25.

At 904, the filler conveyor belt 25 facilitates the movement of the filler material 22 into the filler conduit 29.

At 906, the metering device 301 deposits the beaded substrate 302 into the filler material 22. In some embodiments, the metering device 301 may deposit the beaded substrate 302 into the filler material 22 while the filler material 22 is still on the filler conveyor belt 25. In some embodiments, the metering device 301 may deposit the beaded substrate 302 into the filler material 22 as the filler material 22 falls from the filler conveyor belt 25 and into the filler conduit 29. In some embodiments, the metering device 301 deposits the beaded substrate 302 directly into the filler conduit 29, where the beaded substrate 302 and the filler material 22 mix together.

At 908, the mixture of the beaded substrate 302 and the filler material 22 leave the filler conduit 29 and land on the spreader belt 31.

At 910, the spreader belt 31 moves the mixture of the filler material 22 and the beaded substrate 302 into the chimney portion 18, where the suction chamber 41 biases the mixture of the filler material 22 and the beaded substrate 302 from the chimney portion 18 and on to the belt 32, forming the stream of aerosol generating product components 45.

At 912, the stream of aerosol generating product components 45 is trimmed by the trimming assembly 52.

At 914, the stream of aerosol generating product components 45 is wrapped in the paper web 60, forming the continuous rod 170. The continuous rod 170 advances toward the cutting mechanism 186.

At 916, the continuous rod 170 is cut at predetermined cut points by the cutting mechanism 186. In some embodiments, the cutting mechanism 186 cooperates with belt 32, garniture belt 130, and metering device 301 to decide where to cut such that the beaded substrate 302 will not fall out of the rod 190 or the continuous rod 170.

Figure 15:
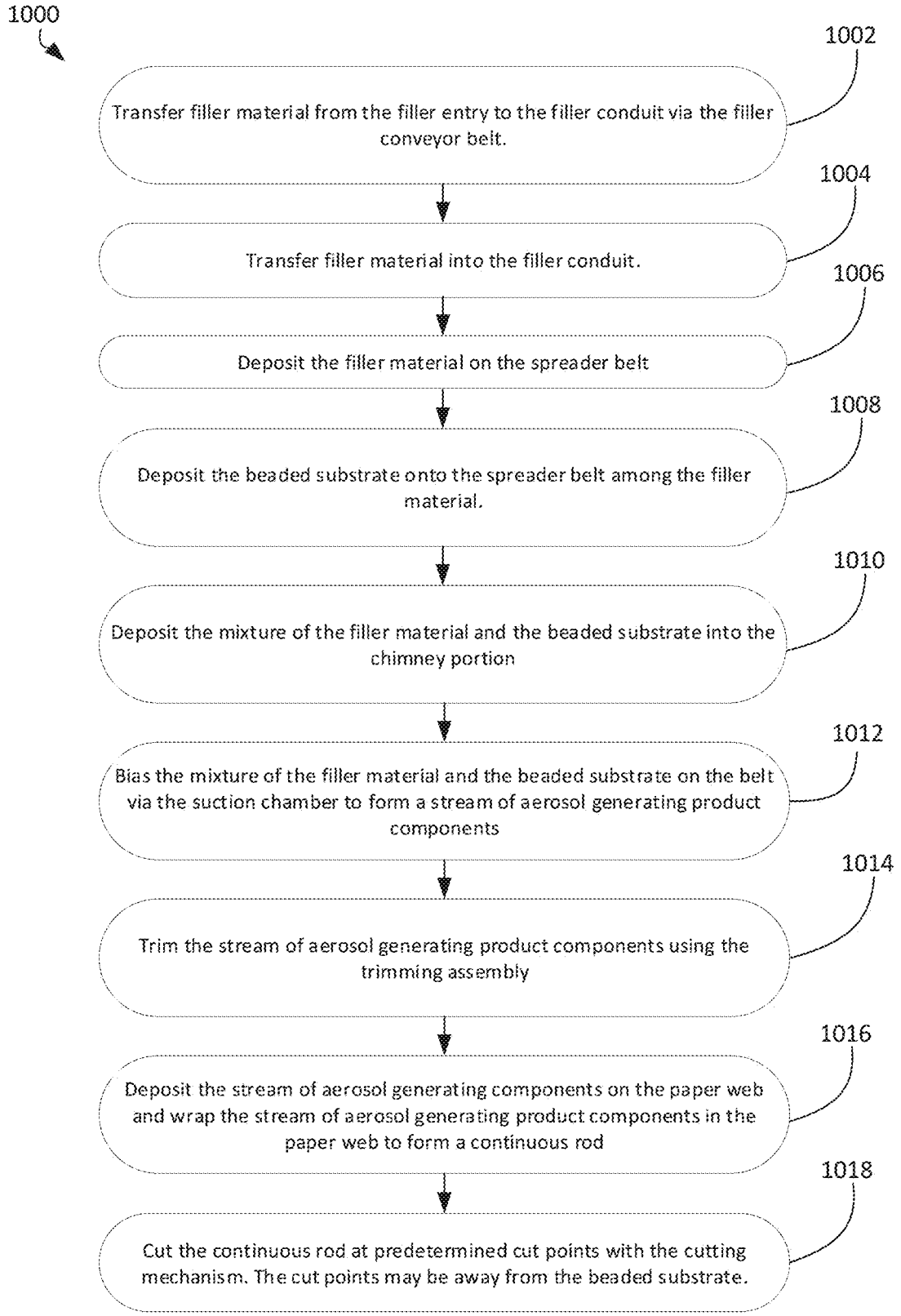
FIG. 15 is a schematic flow diagram of a method for manufacturing a rod with a beaded substrate disposed within, according to yet another example embodiment.

Referring to FIG. 15, yet another method for manufacturing a rod 190 is shown as a method 1000. The method 1000 relates most generally to the metering device 301 disclosed above, disposed above the spreader belt 31 and mounted to the outside of the rod wrapping machine 16. At 1002, the filler material 22 is transferred from the filler entry 27 toward the filler conduit 29 by the filler conveyor belt 25.

At 1004, the filler material 22 moves into the filler conduit 29. At 1006, the filler material 22 falls onto the spreader belt 31.

At 1008, the metering device 301 deposits the beaded substrate 302 into the filler material 22. In some embodiments, the metering device 301 may deposit the beaded substrate 302 into the filler material 22 while the filler material 22 is on the spreader belt 31. In some embodiments, the beaded substrate 302 may include an adhesive coating that keeps the beaded substrate 302 held within the filler material 22. The beaded substrate 302 and the filler material 22 may mix together to form the aerosol generating product components 45.

At 1010, spreader belt 31 translates the mixture of the beaded substrate 302 and the filler material 22 into the chimney portion 18.

At 1012, the suction chamber 41 biases the mixture of the filler material 22 and the beaded substrate 302 from the chimney portion 18 and on to the belt 32, forming the stream of aerosol generating product components 45.

At 1014, the stream of aerosol generating product components 45 is trimmed by the trimming assembly 52.

At 1016, the stream of aerosol generating product components 45 is wrapped in the paper web 60, forming the continuous rod 170. The continuous rod 170 advances toward the cutting mechanism 186.

At 1018, the continuous rod 170 is cut at predetermined cut points by the cutting mechanism 186. In some embodiments, the cutting mechanism 186 cooperates with belt 32, garniture belt 130, and metering device 301 to decide where to cut such that the beaded substrate 302 will not fall out of the rod 190 or the continuous rod 170.

Figure 16A:
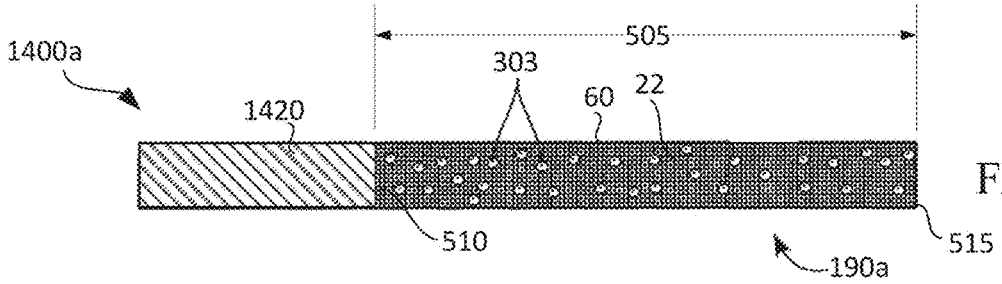
FIG. 16A is a cross-sectional view of a smoking article, according to an example embodiment.

Referring generally to FIG. 16A-16F, various smoking articles having a rod 190 manufactured by the methods disclosed herein are disclosed. It should be appreciated that the rods 190*a*, 190*b*, 190*c*, 190*d*, and 190*e* may be used with systems for and methods of use of electrically heated tobacco products (EHTP). In one such embodiment, the rod 190 may be configured to have a diameter and a rod length appropriate for use in a heated tobacco unit. Referring specifically to FIG. 16A, a cross-sectional view of a smoking article 1400*a* having a filter 1420 and a rod 190*a* according to a first embodiment is shown. The rod 190*a* is manufactured by the rod wrapping machine 16 using the methods disclosed herein. The rod has a first end 510 and a second end 515. The rod 190*a* includes the beaded substrate 302 and the filler material 22. The beaded substrate 302 is disposed within the filler material 22 at random. The beaded substrate 302 is not organized in any particular pattern, but the beaded substrate 302 is evenly distributed throughout the rod length 505 of the rod 190*a*.

Figure 16B:
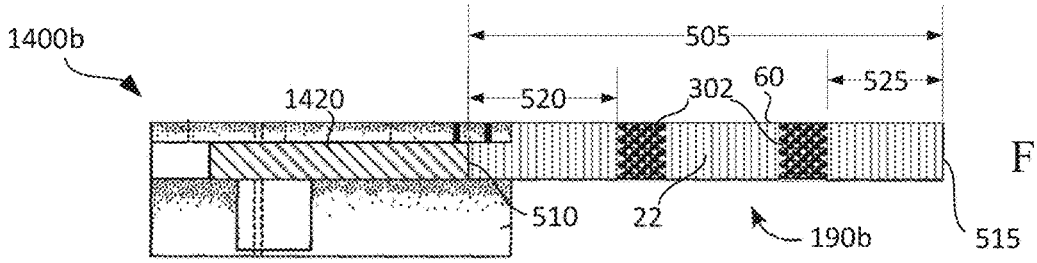
FIG. 16B is a cross-sectional view of a smoking article, according to another example embodiment.

Referring to FIG. 16B, a cross-sectional view of a smoking article 1400*b* having the filter 1420 and a rod 190*b* is shown. The rod 190*b* is similar to the rod 190*a*. One difference between rod 190*b* and rod 190*a* is that rod 190*b* has the beaded substrate 302 separating the filler material 22 into various sections. The rod 190*b* is manufactured by the rod wrapping machine 16 using the methods disclosed herein. In some embodiments, the beaded substrate 302 separates the filler material 22 into two sections. In other embodiments, the beaded substrate 302 separates the filler material 22 into three sections. In other embodiments, the beaded substrate 302 separates the filler material 22 into more than three sections. The beaded substrate 302 is separated from the first end 510 such that the beaded substrate 302 does not spill out of the first end 510 of the rod 190*b*. The beaded substrate 302 may be separated from the first end 510 by 5-15 mm. In some embodiments, the beaded substrate 302 is separated from the first end by 8-12 mm. In other embodiments, the beaded substrate 302 is separated from the first end by 7-10 mm.

As shown in FIG. 16B, the beaded substrate 302 is disposed the first distance 520 from the first end 510. The first distance 520 measures approximately 10 mm (8-12 mm) such that the beaded substrate 302 does not fall out of the first end 510 when the rod 190*b* is cut to the rod length 505. The first distance 520 is measured from the first end 510 to the left-most bead 303 in the rod 190*b*. The beaded substrate 302 is also separated from the second end 515 by the second distance 525 such that the beaded substrate 302 does not fall out of the second end 515 when the rod 190*b* is cut to the rod length 505. The second distance 525 is measured from the second end 515 to the right-most bead 303 in the rod 190*b*. The beaded substrate 302 may be separated from the second end 515 by 15-25 mm. In some embodiments, the beaded substrate 302 is separated from the second end 515 by 25-35 mm. In other embodiments, the second distance 525 is over twice the distance as the first distance 520. In still other embodiments, the second distance 525 is over three times the distance as the first distance 520.

Figure 16C:
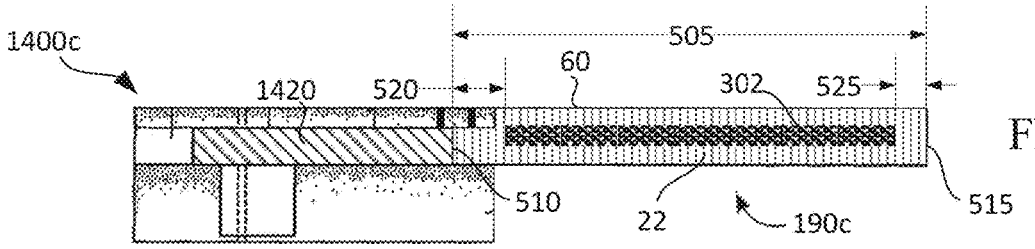
FIG. 16C is a cross-sectional view of a smoking article, according to yet another example embodiment.

Referring to FIG. 16C, a cross-sectional view of a smoking article 1400*c* including the filter 1420 and a rod 190*c* according to yet another embodiment is shown. The rod 190*c* is similar to the rod 190*a*. One difference between the rod 190*c* and the rod 190*a* is that the beaded substrate 302 disposed within the rod 190*c* is contiguous (e.g., each bead 303 of the beaded substrate 302 is in contact with at least one other bead 303) and separated from the paper web 60. The rod 190*c* is manufactured by the rod wrapping machine 16 using the methods disclosed herein. The rod 190*c* includes the beaded substrate 302 disposed within the center of the rod 190*c*. The beaded substrate 302 is disposed a first distance 520 from the first end 510 such that the beaded substrate 302 does not fall out of the first end 510 when the rod 190*c* is cut to the rod length 505. The first distance 520 is measured from the first end 510 to the left-most bead 303 in the rod 190*c*. The beaded substrate 302 is also disposed a second distance 525 from the second end 515 such that the beaded substrate 302 does not fall out of the second end 515 when the rod 190*c* is cut to the rod length 505. The second distance 525 is measured from the second end 515 to the right-most bead 303 in the rod 190*c*.

Figure 16D:
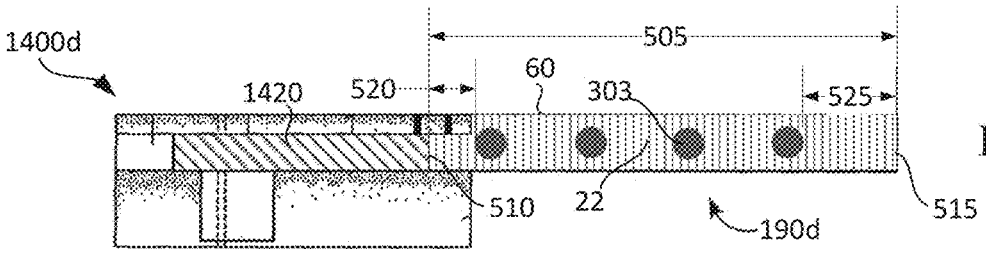
FIG. 16D is a cross-sectional view of a smoking article, according to even yet another example embodiment.

Referring to FIG. 16D, a cross-sectional view of a smoking article 1400*d* having the filter 1420 and a rod 190*d* according to a further embodiment is shown. The rod 190*d* is similar to the rod 190*c*. A difference between the rod 190*d* and the rod 190*c* is that the beaded substrate 302 disposed within the rod 190*d* is not contiguous (e.g., at least one bead 303 is not in contact with another bead 303). The rod 190*d* is manufactured by the rod wrapping machine 16 using the methods disclosed herein. The rod 190*d* includes the beaded substrate 302 disposed at intervals within the rod 190*d*. In some embodiments, each bead 303 of the beaded substrate 302 is of equal size. In other embodiments, each bead 303 of the beaded substrate 302 is of different size. Each bead 303 is disposed within the filler material 22 such that the bead 303 is entirely surrounded by the filler material 22. In some embodiments, the bead 303 is disposed within the rod 190*d* such that the bead 303 makes contact with the paper web 60. In some embodiments, a distance between each bead 303 is the same. In other embodiments, the distance between each bead 303 is different. The left-most bead 303 is disposed a first distance 520 from the first end 510 such that the left-most bead 303 does not fall out of the first end 510 when the rod 190*d* is cut to the rod length 505. The right-most bead 303 is also disposed a second distance 525 from the second end 515 such that the right-most bead 303 does not fall out of the second end 515 when the rod 190*d* is cut to the rod length 505.

Figure 16E:
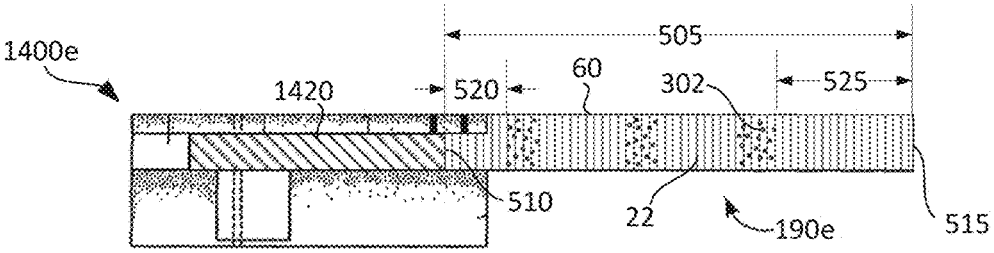
FIG. 16E is a cross-sectional view of a smoking article, according further to even yet another example embodiment.

Referring to FIG. 16E, a cross-sectional view of a smoking article 1400*e* having the filter 1420 and a rod 190*e* according to a fifth embodiment is shown. The rod 190*e* is similar to the rod 190*a*. A difference between the rod 190*e* and the rod 190*a* is that the beaded substrate 302 disposed within the rod 190*e* is not evenly distributed (the beaded substrate 302 is disposed in higher concentrations in some portions of the rod 190*e*). The rod 190*e* is manufactured by the rod wrapping machine 16 using the methods disclosed herein. The rod 190*e* includes the beaded substrate 302 disposed at intervals within the rod 190*e*. In some embodiments, each bead 303 of the beaded substrate 302 is of equal size. In other embodiments, each bead 303 of the beaded substrate 302 is of different size. Each bead 303 is disposed within the filler material 22 such that the bead 303 is entirely surrounded by the filler material 22. In some embodiments, the bead 303 is disposed within the rod 190*d* such that the bead 303 makes contact with the paper web 60. In other embodiments, the bead 303 is disposed within the rod 190*e* such that any one bead 303 is in contact with the paper web 60. In other embodiments, the beaded substrate 302 is disposed in the rod 190*e* such that any bead 303 may be in contact with another bead 303. In some embodiments, a distance between each bead 303 is the same. In other embodiments, the distance between each bead 303 is different. The beaded substrate 302 is disposed a first distance 520 from the first end 510 such that the beaded substrate 302 does not fall out of the first end 510 when the rod 190*e* is cut to the rod length 505. The first distance 520 is measured from the first end 510 to the left-most bead 303 in the rod 190*e*. The beaded substrate 302 is also disposed a second distance 525 from the second end 515 such that the beaded substrate 302 does not fall out of the second end 515 when the rod 190*e* is cut to the rod length 505. The second distance 525 is measured from the second end 515 to the right-most bead 303 in the rod 190*e*.

Figure 16F:
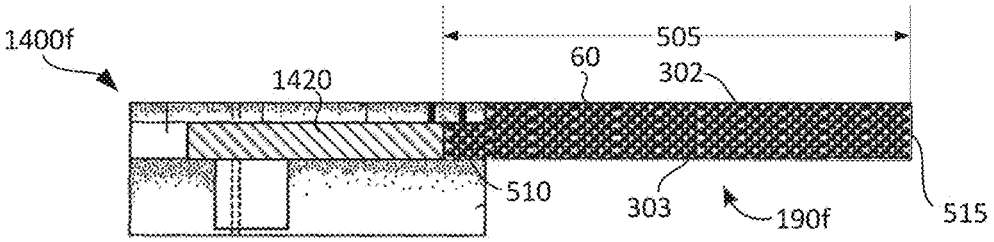
FIG. 16F is a cross-sectional view of a smoking article, according further to even yet another example embodiment.

Referring to FIG. 16F, a cross-sectional view of a smoking article 1400*f* having the filter 1420 and a rod 190*f* according to a sixth embodiment is shown. The rod 190*f* is similar to the rod 190*a*. A difference between the rod 190*e* and the rod 190*a* is that the rod 190*f* does not include any of the filler material 22. The rod 190*f* is filled entirely by the beaded substrate 302, from the first end 510 to the second end 515. The rod 190*f* is manufactured by the rod wrapping machine 16 using the methods disclosed herein. In some embodiments, each bead 303 of the beaded substrate 302 is of equal size. In other embodiments, each bead 303 of the beaded substrate 302 is of a different size. The rod 190*f* is cut to the rod length 505.

Figure 17A:
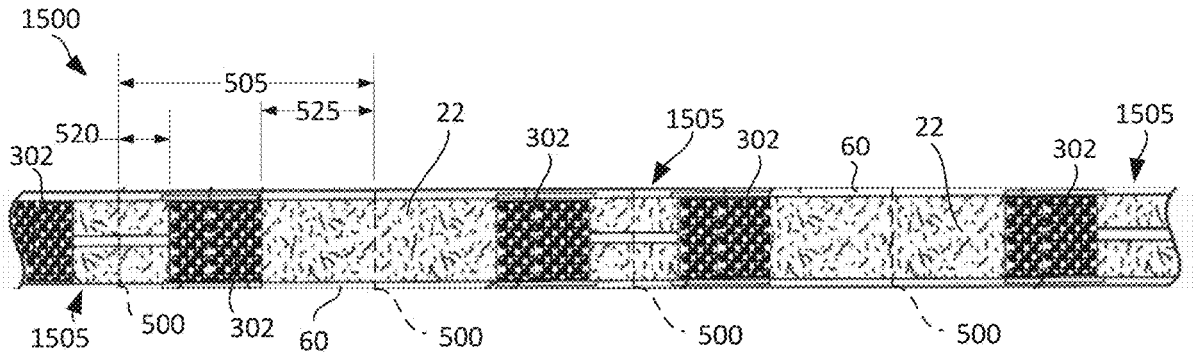
FIG. 17A is a cross-sectional view of a continuous rod with a beaded substrate, according to another example embodiment

Referring to FIG. 17A, a cross-sectional view of a portion of a continuous rod 1500 is shown according to an example embodiment. The continuous rod 1500 is similar to the continuous rod 170. A difference between the two is that the continuous rod 1500 includes a two-up heat generation segment 1505 placed at intervals within. The two-up heat generation segment 1505 is configured to heat the beaded substrate 302 and/or the filler material 22 such that aerosol is released. Such types of smoking products and associated components are proposed, described, and referenced in U.S. Pat. App. No. 2015/0157052, incorporated by reference in its entirety.

Figure 17B:
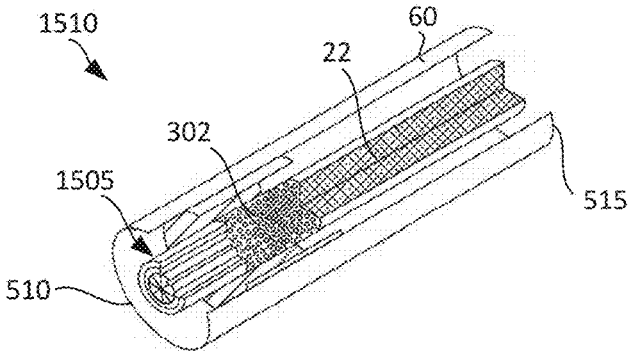
FIG. 17B is an exploded, perspective view of a portion of the continuous rod of FIG. 17A.

The continuous rod 1500 includes, disposed within the paper web 60 and the filler material 22, the beaded substrate 302. The continuous rod 1500 is cut by the cutting mechanism 186 at the cut point 500. The cutting mechanism 186 may cut the two-up heat generation segment 1505 in half. Turning to FIG. 17B, a perspective view of a rod 1510 of the rod length 505 is shown.

Figure 17C:
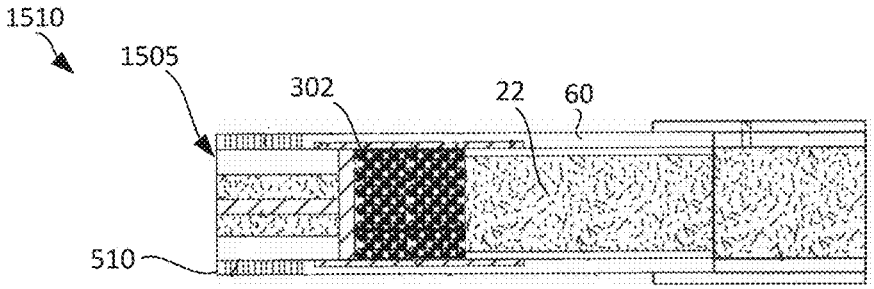
FIG. 17C is a cross-sectional view of a portion of the continuous rod of FIG. 17A.

Turning to FIG. 17C, a rod 1510 of the rod length 505 is shown. The rod 1510 has two ends, shown as the first end 510 and the second end 515. The first end 510 is opposite of the second end 515. Within the rod 1510 may be the beaded substrate 302 and/or the filler material 22. The beaded substrate 302 is disposed the first distance 520 from the first end 510; and the beaded substrate 302 is disposed the second distance 525 from the second end 515.

It should be appreciated that the two-up heat generation segments 1505 may be coupled to the end of any of rods 190*a-f*. In some embodiments, the two-up heat generation segment 1505 may be coupled to the second end 515 of any of the rods 190*a-f* through the use of tipping paper. Likewise, a filter (e.g., filter 1420) may be coupled to any of rods 190*a-f* proximate the first end 510. Using the two-up heat generation segment 1505 coupled to the second end 515 of one of the rods 190*a-f* may be advantageous as the rod 190*a-f*, and thus the beaded substrate 302 within the rod 190*a-f*, will not combust, but burn down enough to release the aerosol from the beaded substrate 302 and the filler material 22.

In some embodiments, any of the rods 190*a-f* may be coupled to a tobacco plug, or a plug of crimped tobacco. For example, the plug of crimped tobacco may be coupled to the second end 515 of the rod 190*c* using tipping paper or the paper web 60. In some embodiments, the plug of crimped tobacco may be inserted into an electric rod heater that heats the plug of crimped tobacco such that when a user breathes in through the first end 510, the aerosol from the plug of crimped tobacco, and thus the hot air from the electric rod heater, pass over the beaded substrate 302 and the filler material 22, releasing more aerosol and providing a pleasant experience to the user.

Figure 18:
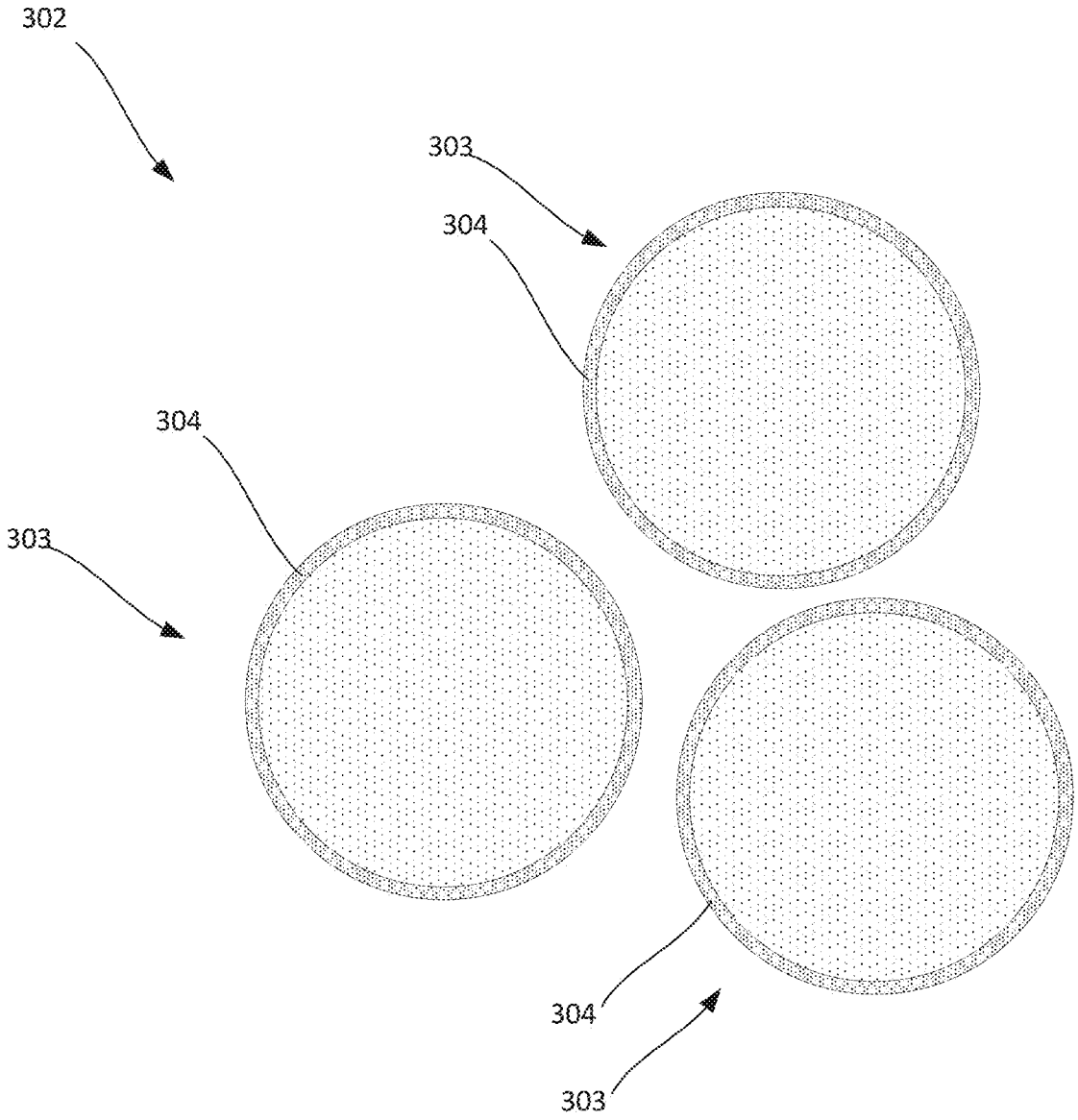
FIG. 18 is a cross-sectional view of the beaded substrate of FIGS. 5-10B and 14A-17C, according to an example embodiment.

Referring to FIG. 18, cross-sectional views of the bead 303 of FIGS. 5-10B and 16A-17C are shown. The bead 303 may have a coating, shown as a coating 304. The coating 304 may include an adhesive to help anchor (e.g., secure, adhere, stick, etc.) the bead 303 within the stream of aerosol generating product components 45. For example, when the beaded substrate 302 is dropped from above, as in method 800, the adhesive may prevent the beaded substrate 302 from hitting the filler material 22 and deflecting away. In other embodiments, the coating 304 includes menthol.

It should be noted that any use of the term "example" herein to describe various embodiments is intended to indicate that such embodiments are possible examples, representations, and/or illustrations of possible embodiments (and such term is not intended to connote that such embodiments are necessarily extraordinary or superlative examples).

As utilized herein, the term "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed (e.g., within plus or minus five percent of a given angle or other value) are considered to be within the scope of the disclosure as recited in the appended claims. The term "approximately" when used with respect to values means plus or minus five percent of the associated value.

The terms "coupled" and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other example embodiments, and that such variations are intended to be encompassed by the present disclosure.

It is important to note that the construction and arrangement of the various example embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Additionally, features from particular embodiments may be combined with features from other embodiments as would be understood by one of ordinary skill in the art. Other substitutions, modifications, changes and omissions may also be made in the design, operating conditions and arrangement of the various example embodiments without departing from the scope of the present disclosure.

What is claimed is:

1. A system for portioning a beaded substrate in a rod, the system comprising:

a suction conveyor belt comprising a belt suction chamber, a first belt end, and a second belt end, the second belt end opposite and downstream of the first belt end; and a metering device configured to provide the beaded substrate to the first belt end, the metering device comprising a reach and a hopper, wherein the reach of the metering device extends vertically from the metering device to a rod wrapping machine.

2. The system of claim 1, wherein the metering device provides the beaded substrate to the first belt end prior to the suction conveyor belt biasing a filler material on the first belt end.

3. The system of claim 1, further comprising:

a garniture portion, the garniture portion configured to wrap a filler material and the beaded substrate in a paper web to form a continuous rod, and a cutting mechanism configured to cut the continuous rod at cut points spaced at constant intervals;

wherein the metering device cooperates with the cutting mechanism to position the beaded substrate a first distance from a first cut end.

4. The system of claim 3, wherein the reach is a feed screw.

5. The system of claim 3, wherein the metering device is coupled to a surface outside of the rod wrapping machine and the reach configured to extend into the rod wrapping machine.

6. The system of claim 1, further comprising a scrape structured to physically remove the beaded substrate from the second belt end.

7. The system of claim 1, wherein the beaded substrate comprises a coating structured to anchor the beaded substrate within a stream of filler material.

8. A system for filling a rod with filler material and a beaded substrate, the system comprising:

a filler conduit arranged to receive the filler material;

a metering device arranged to deposit the beaded substrate into the filler conduit, the beaded substrate mixing with the filler material in the filler conduit to form aerosol generating product components;

a spreader belt arranged to receive the aerosol generating product components; and a chimney portion arranged to receive the aerosol generating product components from the spreader belt.

9. The system of claim 8, further comprising a suction conveyor system comprising a belt, the belt being arranged to form a stream of aerosol generating product components suctioned from the chimney portion.

10. The system of claim 9, further comprising:

a trimming assembly arranged to receive the stream of aerosol generating product components, wherein the stream of aerosol generating product components is advanced longitudinally toward the trimming assembly, wherein the trimming assembly is configured to trim a portion of the stream of aerosol generating product components to a uniform thickness; and a paper web arranged to wrap the portion of the stream of aerosol generating product components so as to form a continuous rod.

11. The system of claim 10, further comprising a cutting mechanism arranged to sever the continuous rod at predetermined intervals to form the rod, the rod comprising the filler material, a first cut end, a second cut end, and the beaded substrate separated from the first cut end, wherein the metering device and the cutting mechanism cooperate to position the beaded substrate a first distance from the first cut end.

12. The system of claim 11, wherein the metering device is further configured to position a second beaded substrate a second distance from the second cut end, the second distance different from the first distance.

13. The system of claim 9, wherein the suction conveyor system comprises:

a first belt end;

a second belt end opposite and downstream of the first belt end; and a low-pressure suction chamber configured to bias the aerosol generating product components from the chimney portion and toward the first belt end.

14. The system of claim 8, wherein the metering device comprises a hopper and a feed screw, the feed screw configured to meter the beaded substrate into the filler conduit intermittently.

15. The system of claim 14, wherein the feed screw is structured to extend into the filler conduit.

16. A system for filling a rod, the system comprising:

a suction belt assembly comprising a belt;

a metering device arranged to present a beaded substrate proximate the suction belt assembly at predetermined time intervals, the beaded substrate being released from the metering device and biased away from the metering device by the suction belt assembly and onto the belt;

a chimney portion comprising filler material, the beaded substrate and the belt being advanced downstream through the chimney portion, wherein a stream of aerosol generating product components is formed by suctioning the filler material from the chimney portion onto the belt and among the beaded substrate;

a trimming assembly arranged to receive the stream of aerosol generating product components, wherein the stream of aerosol generating product components is advanced longitudinally toward the trimming assembly, wherein the trimming assembly is configured to trim a portion of the stream of aerosol generating product components to a uniform thickness; and a paper web arranged to receive the portion of the stream of aerosol generating product components.

17. The system of claim 16, wherein the paper web is arranged to wrap the portion of the stream of aerosol generating product components in the paper web so as to form a continuous rod.

18. The system of claim 17, further comprising a cutting mechanism arranged to sever the continuous rod at predetermined intervals to form the rod, the rod comprising the filler material, a first cut end, a second cut end, and the beaded substrate separated from the first cut end and the second cut end, wherein the metering device and the cutting mechanism cooperate to position the beaded substrate a first distance from the first cut end and a second distance from the second cut end.

19. The system of claim 18, wherein the first distance is different from the second distance.

20. The system of claim 18, wherein the metering device is configured to send a signal to the cutting mechanism when the metering device releases the beaded substrate proximate the suction belt assembly.

21. The system of claim 16, wherein a scrape is used to facilitate disposing the portion of the stream of aerosol generating product components onto the paper web.

* * * * *